US006007066A

United States Patent [19]

Moody

[11] Patent Number: 6,007,066

[45] **Date of Patent: *Dec. 28, 1999**

[54] ELECTRONIC VIDEO POKER GAMES

[76] Inventor: Ernest W. Moody, 4381 Pebble Beach Dr., Longmont, Colo. 80503

[ * ] Notice: This patent is subject to a terminal disclaimer.

[21] Appl. No.: 09/083,531

[22] Filed: May 22, 1998

Related U.S. Application Data

[63] Continuation-in-part of application No. 08/495,952, Jun. 28, 1995, Pat. No. 5,531,448, application No. 08/755,174, Nov. 25, 1996, Pat. No. 5,732,950, and application No. 08/900,965, Jul. 25, 1997, Pat. No. 5,823,873

[60] Provisional application No. 60/019,879, Jun. 17, 1996.

[51] Int. Cl.[6] ..... A63F 1/00

[52] U.S. Cl. ..... 273/292; 463/13

[58] Field of Search ..... 273/292, 274, 273/309; 463/13

[56] References Cited

U.S. PATENT DOCUMENTS

| | | | |
|---|---|---|---|
| 5,265,882 | 11/1993 | Malek | 273/292 |
| 5,328,189 | 7/1994 | Malek | 273/292 |
| 5,356,140 | 10/1994 | Dabrowski et al. | 273/292 |
| 5,377,993 | 1/1995 | Josephs | 273/292 |
| 5,486,005 | 1/1996 | Neal | 273/292 |
| 5,496,038 | 3/1996 | Kangsanaraks | 273/292 |
| 5,573,249 | 11/1996 | Johnson | 273/292 |
| 5,577,731 | 11/1996 | Jones | 273/292 |
| 5,639,092 | 6/1997 | Macaisa | 273/292 |
| 5,664,781 | 9/1997 | Feola | 273/292 |
| 5,816,915 | 10/1998 | Kadlic | 463/13 |

*Primary Examiner*—Benjamin H. Layno
*Attorney, Agent, or Firm*—John Edward Roethel

[57] ABSTRACT

The method of the present invention involves a card game in which at least two rows of cards, and preferably three rows, are dealt to a player. The player makes a wager for each row of cards. All three rows of cards are dealt face up with each row having the same cards by rank and suit. The player selects none, one or more of the face up cards from one of the rows as cards to be held. The cards that are held are also held in all of the other rows. Replacement cards for the non-selected cards are dealt into each row. The poker hand ranking of each five card hand by row is determined. The player is then paid for any winning poker hands based on a pay table and the amount of the player's wager.

17 Claims, 26 Drawing Sheets

ELECTRONIC VIDEO POKER GAMES

CROSS-REFERENCE TO RELATED APPLICATIONS

This application is a Continuation-in-Part of application Ser. No. 08/495,952, entitled "Poker-Style Card Game", filed Jun. 28, 1995, now U.S. Pat. No. 5,531,448; and is also based on and is a Continuation-in-Part of Provisional Application Ser. No. 60/019,879, entitled "Electronic Video Poker Games", filed Jun. 17, 1996; and is also a Continuation-in-Part of application Ser. No. 08/755,174, entitled "Electronic Video Poker Games", filed Nov. 25, 1996, now Pat. No. 5,732,950; and is also a Continuation-in-Part of application Ser. No. 08/900,965, entitled "Electronic Video Poker Games", filed Jul. 25, 1997, now U.S. Pat. No. 5,823,873.

BACKGROUND OF THE INVENTION

This invention relates primarily to electronic video poker games, and more particularly to electronic video poker games that are based on poker hand rankings and that allow the player to discard and replace unwanted cards with replacement cards. The present invention has many versions with the common thread being that cards are duplicated from a first row of cards into one or more additional rows to allow the player the opportunity to play one or more cards from the staring row of cards multiple times. The invention also involves features which may apply to casino table games as well.

SUMMARY OF THE INVENTION

The method of the present invention involves a card game in which at least two rows of cards, and preferably three rows, are dealt to a player. The player makes a wager for each row of cards. One row of five cards are dealt all face up. The player selects none, one or more of the face up cards from the first row as cards to be held. The cards that are held are duplicated from the first row into all of the other rows. Replacement cards for the non-selected cards are dealt into the first row. Additional cards are also dealt to all of the other rows so that each row is a five card hand. The poker hand ranking of each five card hand is determined row by row. The player is then paid for any winning poker hands based on a pay table and the amount of the player's wager.

DETAILED DESCRIPTION OF THE PREFERRED EMBODIMENTS

The present invention includes a variety of electronic video poker games. Each electronic video poker game is designed to be played by having the hands displayed on a video screen to a player. By manipulating the buttons on the gaming device or by using conventional touch screen technology, the player selects which cards he wishes to play, which cards he wishes to move from one location to another on the screen display and which cards he wishes to discard. Replacement cards are then displayed for the discarded cards and the outcome of the play of the hand is determined.

Version #1—Super Poker I

Figure 1:
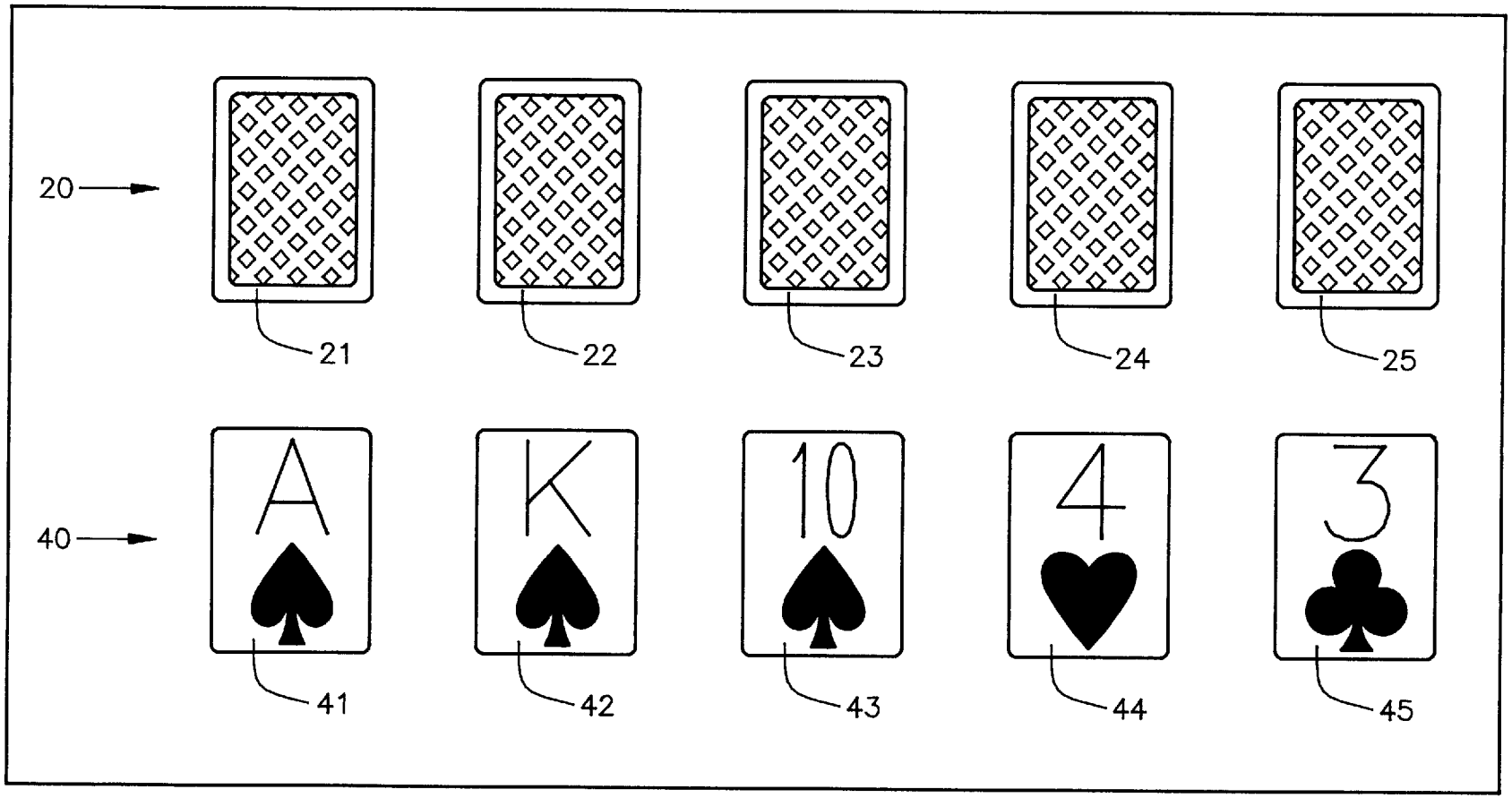
FIG. 1 shows the screen display for Version #1 of the present invention after the initial deal of the cards.

Version #1 of the invention is a poker-type game in which two horizontal rows of five cards each are displayed on a video screen. FIG. 1 shows the screen display for this game at the point in which the two initial five card hands are dealt and displayed to the player. A conventional deck of fifty-two cards is used. Two five card hands are dealt to the player. The first hand 20 is a five card stud poker hand dealt face down. The second hand 40 is a five card draw poker hand dealt face up. In the preferred embodiment of the present invention, the second hand 40 is aligned card-for-card over the first hand. In the preferred embodiment of the present invention, the player makes two wagers—one for the stud poker hand and one for the draw poker hand.

As an example, FIG. 1 shows the first hand 20 comprising five cards 21, 22, 23, 24 14 and 25 all displayed face down.

The second hand 40 comprises five face up cards—the Ace of Spades 41, the King of Spades 42, the Ten of Spades 42, the Four of Hearts 44 and the Three of Clubs 45.

The player first plays the five card draw poker hand. The player selects which of the five cards he wishes to discard and replacement cards for the discarded cards come from the stud poker hand. In the preferred embodiment of the present invention, the replacement cards are selected by using the card from the first hand 20 that is vertically aligned with the discarded card from the second hand 40.

Again with reference to FIG. 1, the player would most likely discard the Four of Hearts 44 and the Three of Clubs 45 and attempt to draw into a Royal Flush in Spades. The cards that the player would receive as replacement cards for his discard are card 24 and card 25 from the first hand 20.

Electronically card 44 would be removed from the screen and card 24 would be reproduced at the screen location where card 44 formerly was. Likewise, card 45 would be removed from the screen display and card 25 would be reproduced at the screen location where card 45 formerly was.

Figure 2:
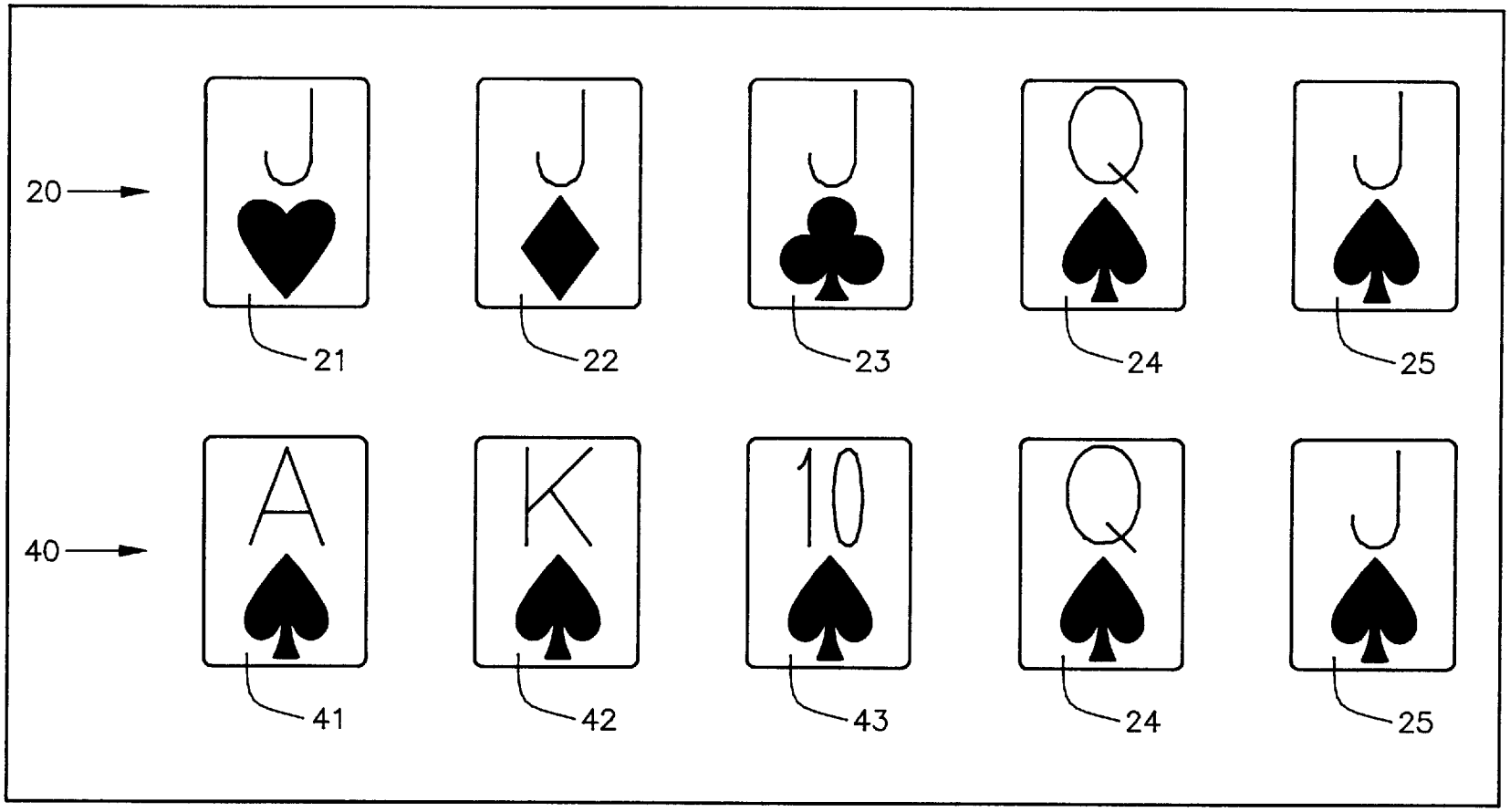
FIG. 2 shows the screen display for Version #1 and shows a result that could occur during the play of the game.

At the same time that this is occurring, all five cards from the first hand 20 are turned face up and displayed to the player. This results in two five card hands being displayed to the player on the screen display as shown in FIG. 2. Any cards from the first hand 20 that are also used as replacement cards in the second hand 40 are therefore displayed twice on the screen display.

Following along with the example from FIG. 1, FIG. 2 shows results that could occur. Assuming the player discarded the Four of Hearts 44 from the second hand 40, the replacement card for card 44 is card 24 (since card 24 is vertically aligned with card 44 on the screen display) from the first hand 20 which turned out to be the Queen of Spades when card 24 is turned face up. Likewise, assuming the player discarded the Three of Clubs 45 from the second hand 40, the replacement card for card 45 is card 25 (since card 25 is vertically aligned with card 45 on the screen display) from the first hand 20 which turned out to be the Jack of Spades when card 25 is turned up.

Thus, the draw hand 40 resulted in a hand having a poker rank of a Royal Flush in Spades. Likewise, when the first hand 20 is turned face up, it resulted in a hand having a poker rank of Four Jacks. The Queen of Spades 24 and Jack of Spades 25 are used in both the first hand 20 and the second hand 40.

Payout schedules are provided for both the five card stud hand 20 and the five card draw hand 40 and a player is paid amounts based on the amount of his wager on each hand according to the payout schedule which is based on poker hand rankings as in conventional video or electronic poker machines.

Suitable payout schedules are used for both the stud hand and the draw poker hand. The payouts can be fixed or flat jackpot amounts being multiples of the amount of the wager. Alternatively, progressive jackpot amounts can be provided for winning combinations. For example, a first progressive jackpot amount can be provided for achieving a Royal Flush in the stud poker hand 20 and a second progressive jackpot amount can be provided for achieving a Royal Flush in the draw poker hand 40.

Figure 3:
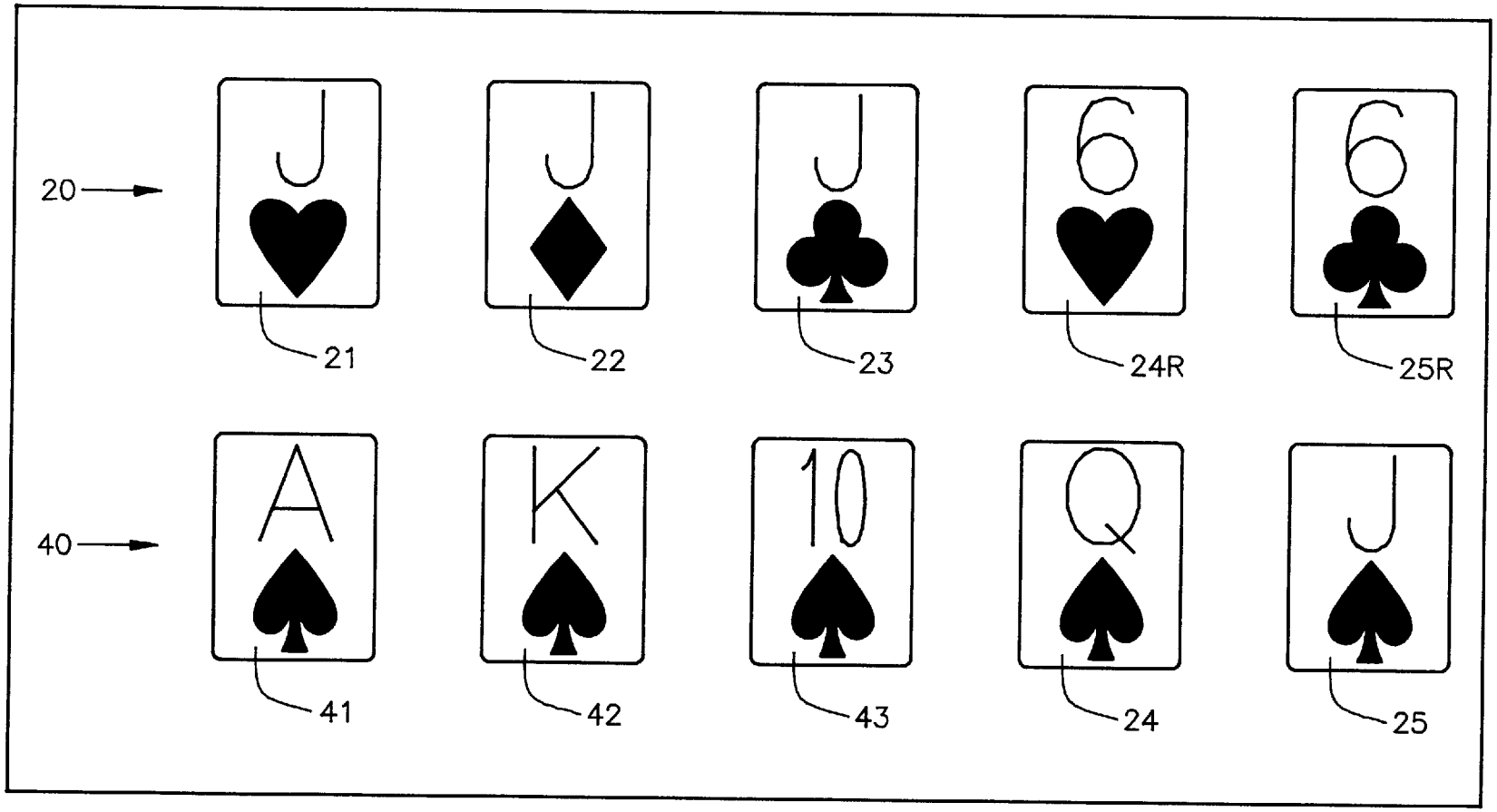
FIG. 3 shows a modification to the method of play of Version #1.

The above-described method of play can be modified in that any cards from the first hand 20 that are used as replacement cards in the second hand would themselves be replaced by new cards from the original deck of fifty-two cards. For example, FIG. 3 shows this modification. After discarding from the second hand 40, the Queen of Spades 24 and the Jack of Spades 25 are physically moved from the first hand 20 to their corresponding vertically aligned locations in the second hand 40. Replacement cards are dealt from the original fifty-two card deck resulting in the Six of Hearts 24R and the Six of Clubs 25R being added to the first hand 20. The resulting hands in this example are a Royal Flush in Spades in the draw poker hand 40 and a Full House in the stud poker hand 20.

This version may also be modified with the use of certain optional features. These features may apply as an option to standard five card video poker, as well. One optional feature is a "Double Down" feature in which the player may double the amount of his original wager if the player achieves certain cards on the initial deal. For example, if a player is dealt one pair in the draw poker hand 40, the player may exercise the option of doubling the amount of his initial wager.

Another optional feature is the "Split" feature. In this feature, the player has the option of splitting the face up cards of the draw hand 40 into two five card hands. This may be done according to rank or suit or any other strategy that the player may wish to employ. For example, if the initial draw hand 40 contains a pair of 6's and a pair of 7's, the player may elect to split these pairs into two separate draw hands. A first draw hand would contain the pair of 6's and the second draw hand would contain the pair of 7's. The initial fifth card would be discarded. The three replacement cards that are now needed to complete each draw hand come from the stud hand and would be the same three cards used in both the first draw hand and the second draw hand. An additional wager would be required for the additional draw hand.

Version #2—Super Poker II (Super Slot Poker)

Version #2 of the present invention is a poker-type card game in which three horizontal rows of cards are displayed to the player. This version has a number of variations which will be explained as follows:

Version #2A. This version of the present invention uses a standard fifty-two card deck. A player makes an initial wager to activate the game. After the wager is made, three horizontal rows of five cards each are displayed to the player on the screen display. The center row is displayed face up, the bottom row is displayed face up and the top row is displayed face down. (Alternatively, the top row is displayed face up and the bottom row is displayed face down, as the preferred embodiment is that two of the rows are face up and one of the rows is face down; it is most preferred that the center row be one of the face up rows as that makes the game easiest to play and understand for the player).

Figure 4:
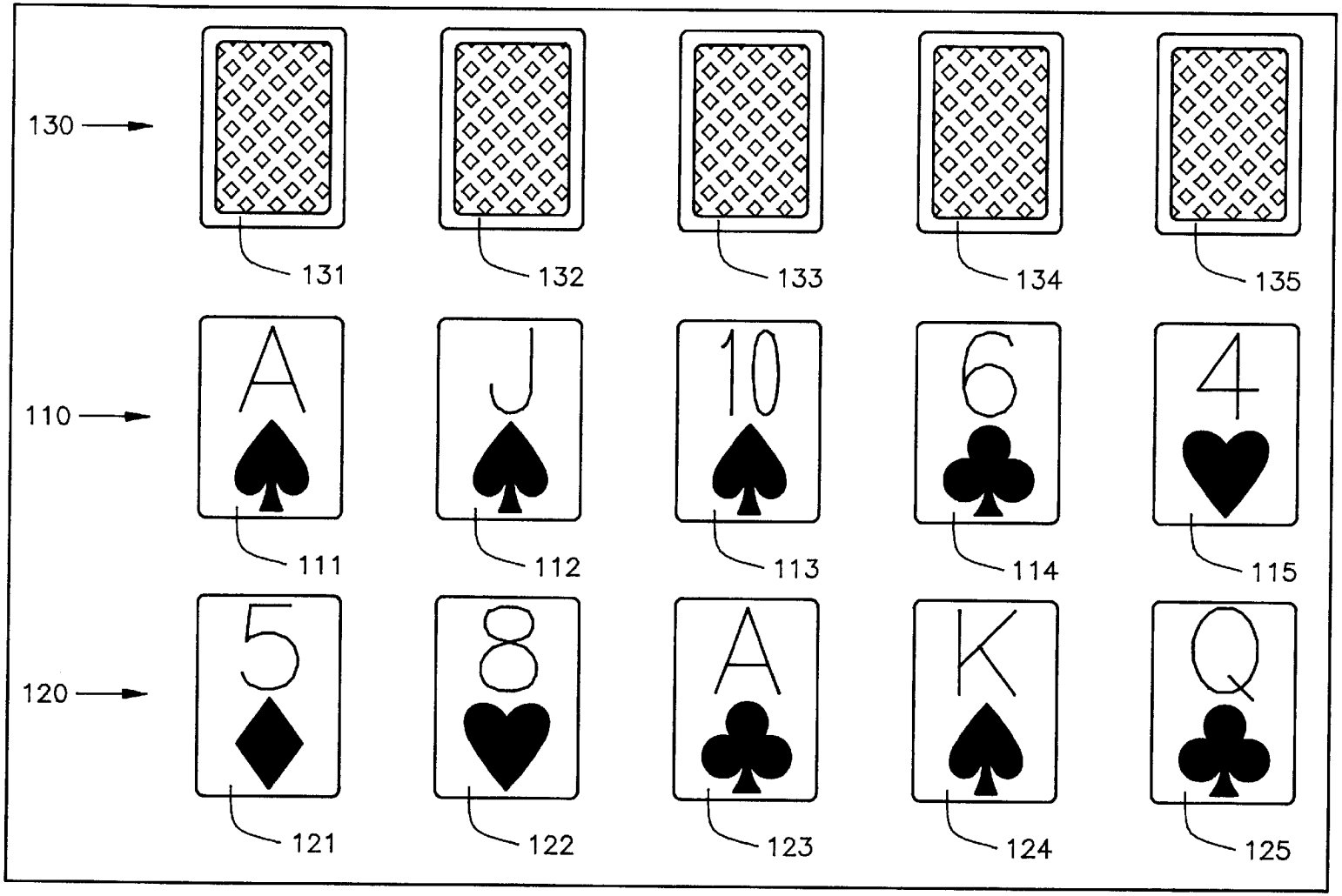
FIG. 4 shows the screen display for Version #2A of the present invention after the initial deal of the cards.

FIG. 4 shows an example of the cards displayed to the player on the initial deal. All fifteen cards are dealt from a single fifty-two card deck of standard playing cards.

The center row 110 is the draw hand to be played by the player and is displayed face up and in this example the player received as the draw hand 110 the Ace of Spades 111, the Jack of Spades 112, the Ten of Spades 113, the Six of Clubs 114 and the Four of Hearts 115. At the same time as the center row 110 is displayed to the player, the bottom row 120 is also displayed on the screen with all cards face up. The cards in the bottom row 120 are vertically aligned with the corresponding cards in the center row 110. In the example shown in FIG. 4, the cards in the bottom row 120 are the Five of Diamonds 121, the Eight of Hearts 122, the Ace of Clubs 123, the King of Spades 124 and the Queen of Clubs 125.

Also, at the same time that the center row 110 and the bottom row 120 cards are dealt, the top row 130 cards are dealt. Five cards 131, 132, 133, 134 and 135 are displayed on the video screen face down and are vertically aligned with the corresponding cards in the center row 110 and the bottom row 120.

Figure 5:
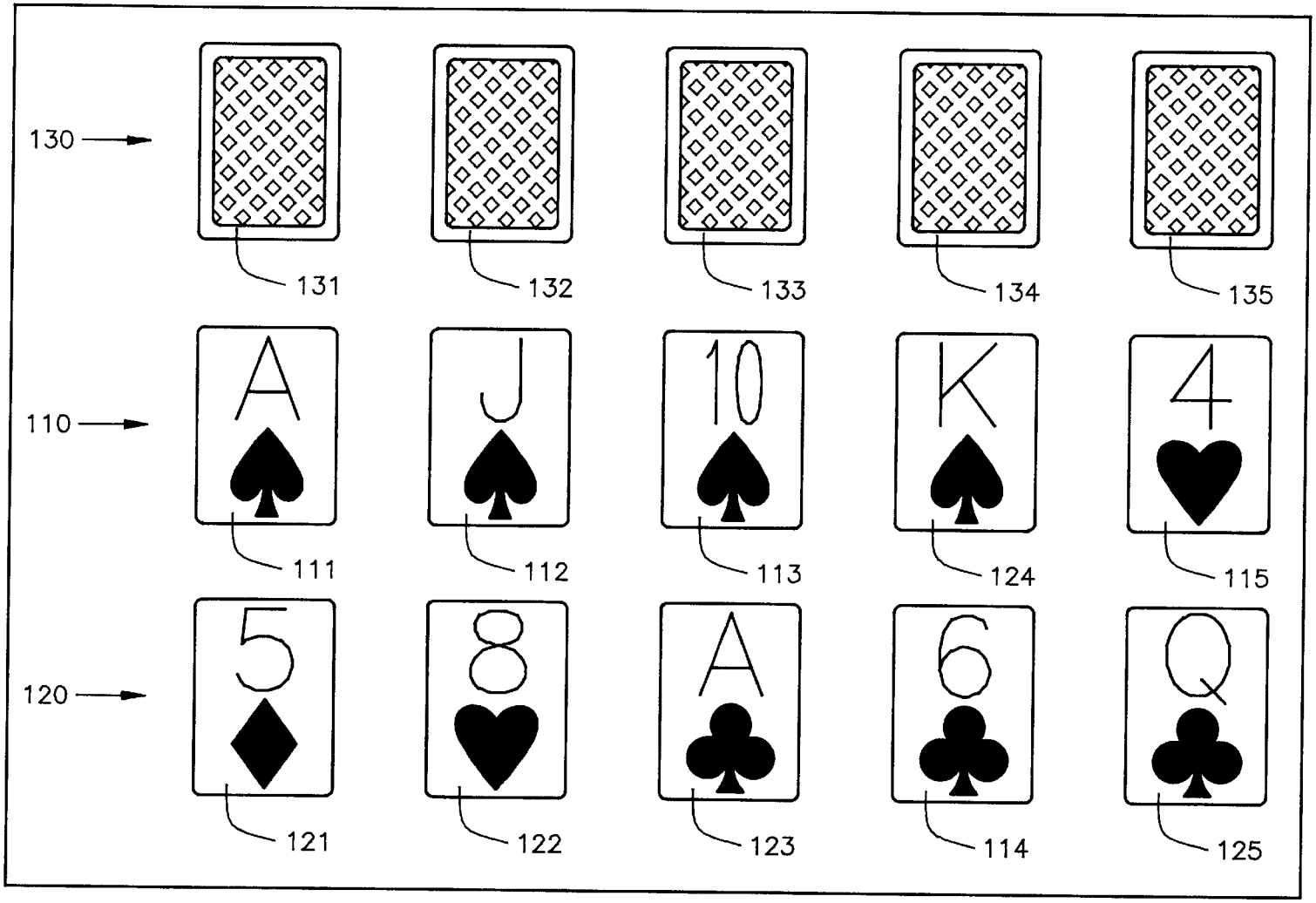
FIG. 5 shows the screen display for Version #2A after the player has selected a replacement card from the bottom row.

The object of the method of play is for the player to attempt to achieve a winning poker hand combination on the five cards in the center row draw hand 110. After the initial deal, the player can first determine whether he wishes to discard up to five cards in the center row 110 and replace the discarded cards, if any, with an exposed card from the bottom row 120. Only cards that are vertically aligned made be used as replacement cards for cards discarded from the center row 110. In the example shown in FIG. 5, the player would discard the Six of Clubs 114 from the center row 110 and replace this card with the corresponding vertically aligned card, the King of Spades 124 from the bottom row 120 in hopes of achieving a Royal Flush in the center row 110.

The player effects this discarding and replacement by manipulating buttons on the gaming device or be using touch screen technology to touch the card locations on the screen. In the preferred embodiment of the present invention, the King of Spades 124 is physically moved on the screen display to the center row 110 and the discarded card, the Six of Clubs 114, is physically moved to the top row 130 on the screen display.

After the player has determined whether to use any one or more of the face up cards from the bottom row 120 as replacement cards for center row 110 cards, the player determines if he wishes to use any one or more of the face down cards from the top row 130 as replacement cards for center row 110 cards. Again by either pressing buttons or using touch screen technology, the player selects which center row 110 cards are to be discarded and replaced by top row 130 cards. Again, only vertically aligned corresponding top row 130 cards can be selected as replacement cards for those cards to be discarded from the center row 110.

Figure 6:
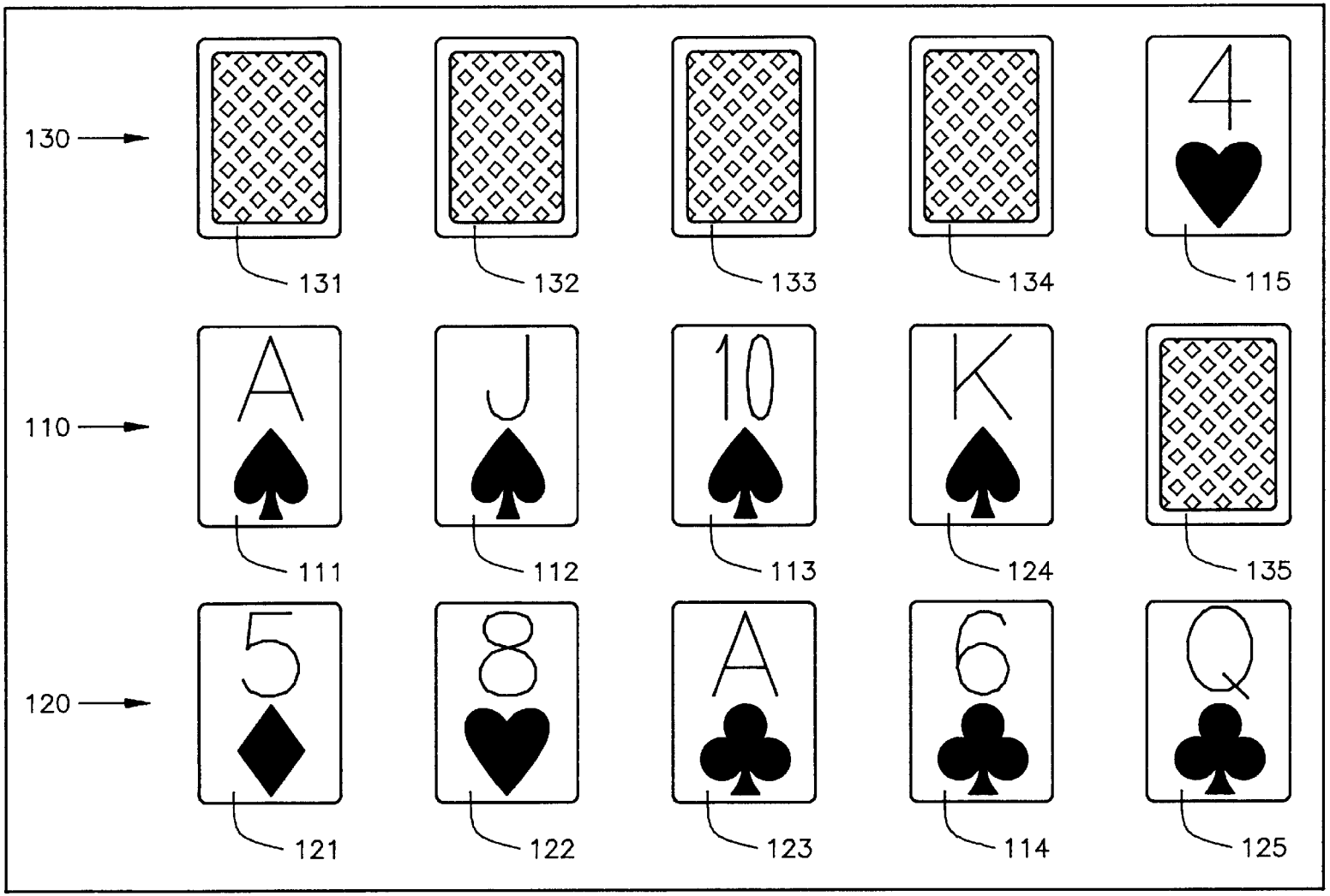
FIG. 6 shows the screen display for Version #2A after the player has received a replacement card from the top row.

FIG. 6 shows in the example that the player has determined to replace the Four of Hearts 115 from the center row 110 with the corresponding top row card 135. The Four of Hearts 115 is physically moved to the bottom row 120 and the top row card 135 is moved to the center row 110 to replace the Four of Hearts. The top row card may itself be replaced by a duplicate of itself or a new face down card. This would allow the player to make a separate bet on the face down stud hand in the top row. The play of the game would be similar to Version #1 except that any face up cards that were moved into the top row would be replaced by new cards when the player presses the "Deal" button.

When the player has completed replacing center row cards with either top or bottom cards and has selected his final five card arrangement for the center row 110, the player presses the "deal" button and all face down cards are turned face up. If the five cards in the center row 110 achieve a winning combination, the player is paid an amount based on the amount of his wager according to a pay table based on poker hand rankings.

In the example, if the face down card 135 when turned face up is the Queen of Spades, the center row 110 cards would achieve a Royal Flush and the player would be paid according to the pay table for a Royal Flush. If the player did not wish to risk trying to achieve a Royal Flush, the player could have taken a lesser payout by using the Queen of Clubs 125 from the bottom row 120 and achieve a simple Straight on the center row and receive the lesser payout from the pay table associated with a Straight.

Figure 7:
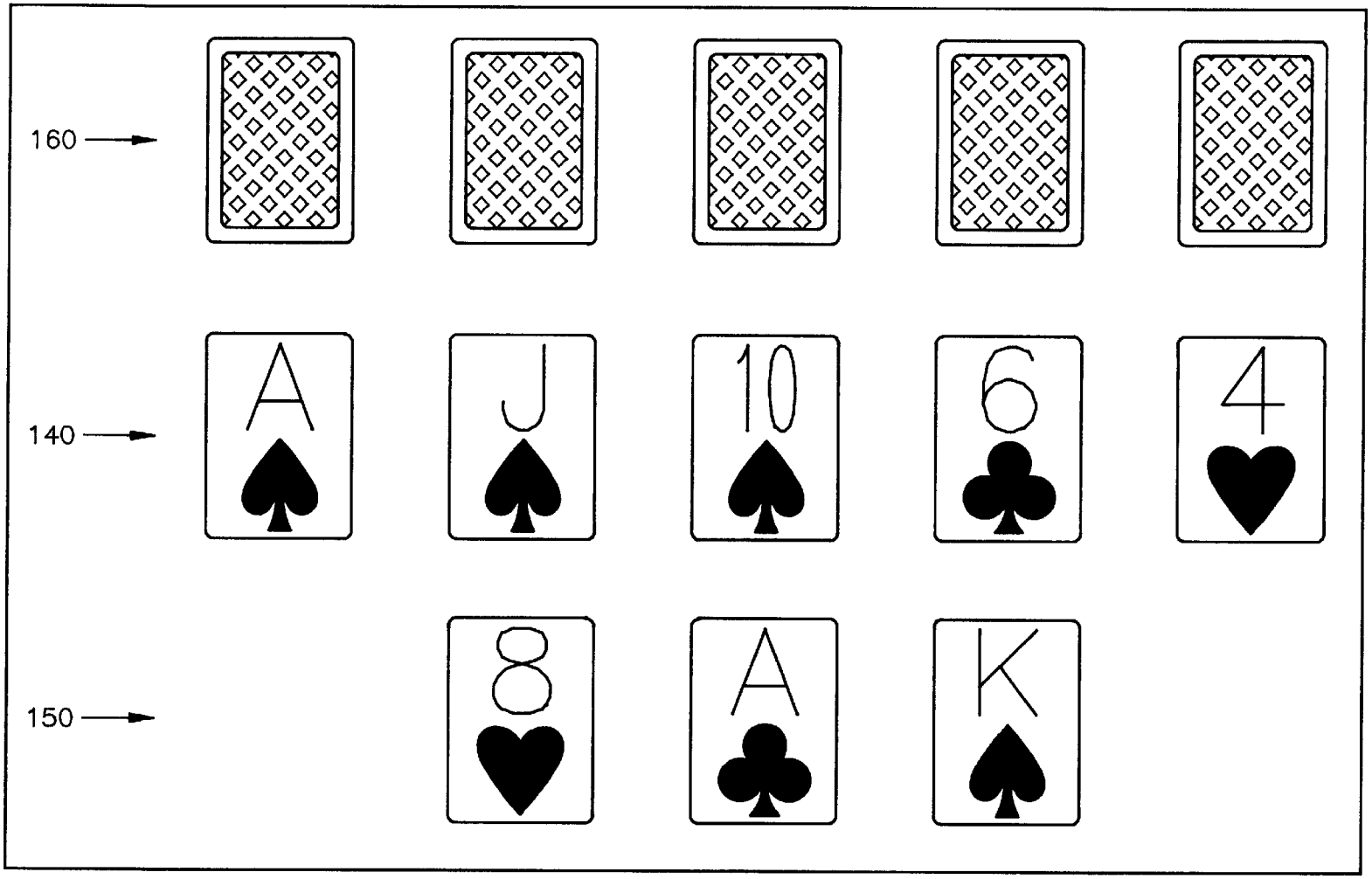
FIG. 7 shows the screen display for Version #2B after the initial deal of the cards.

Version #2B: This version plays the same as Version #2A. The center row 140 is dealt face up and the top row 160 is dealt face down. The two face up replacement cards at each end of the bottom row 150 are eliminated as shown in FIG. 7. Thus the player only has three face up replacement cards in the bottom row 150 and the player will have fewer options for replacement cards in this version.

Figure 8:
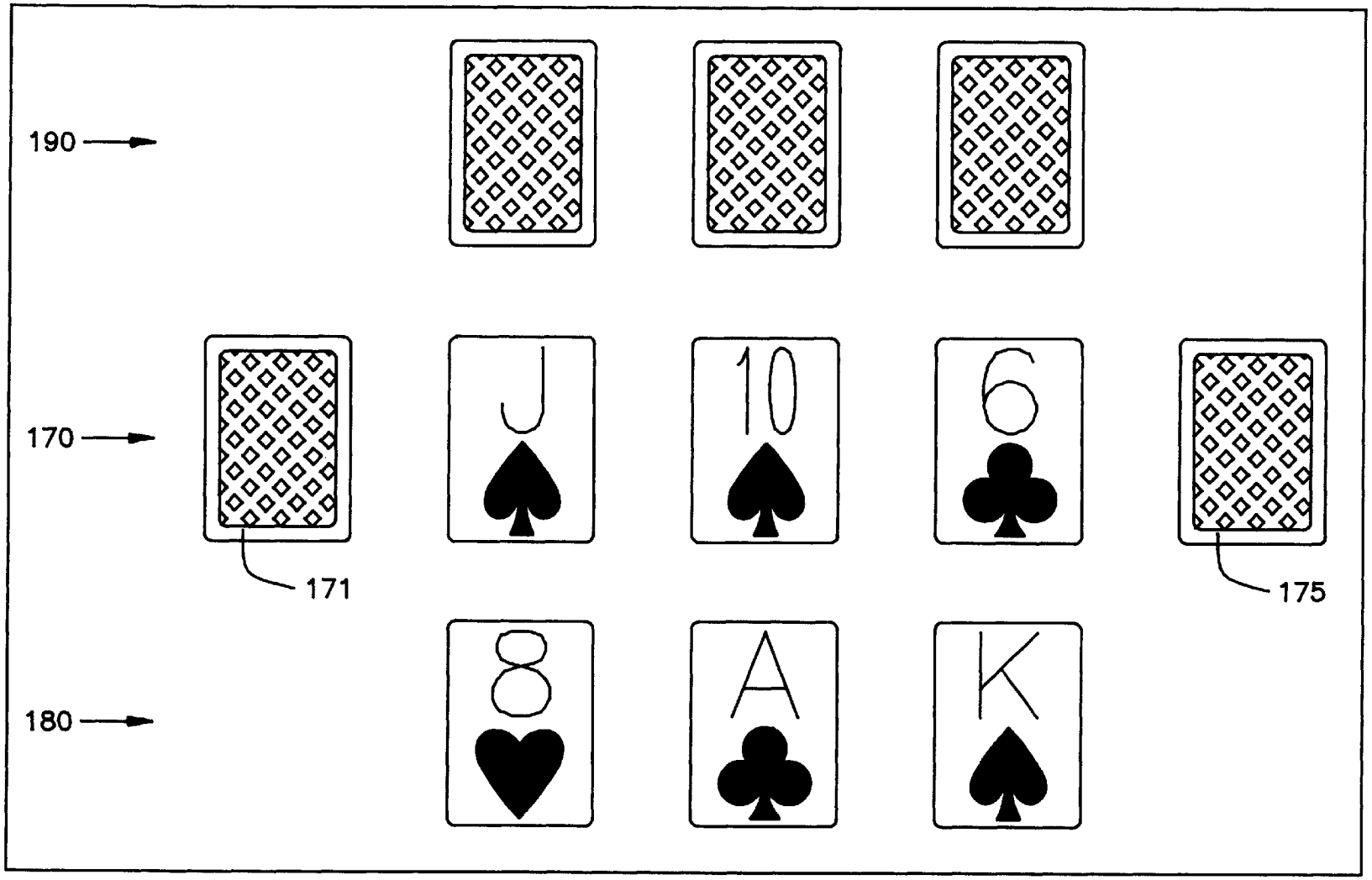
FIG. 8 shows the screen display for Version #2C after the initial deal of the cards.

Version #2C: Again, this version plays the same as Version #2A. As shown in FIG. 8, the center row 170 has its two end cards 171 and 175 dealt face down with the three remaining center row cards dealt face up. The top row 190 has only three cards all dealt face down and the bottom row 180 has only three cards all dealt face up. After the player has made his selections regarding replacement cards, the face down cards 171 and 175 in the center row 170 are then revealed. There are no replacement cards for the two end cards 171 and 175 of the center row 170.

Figure 9:
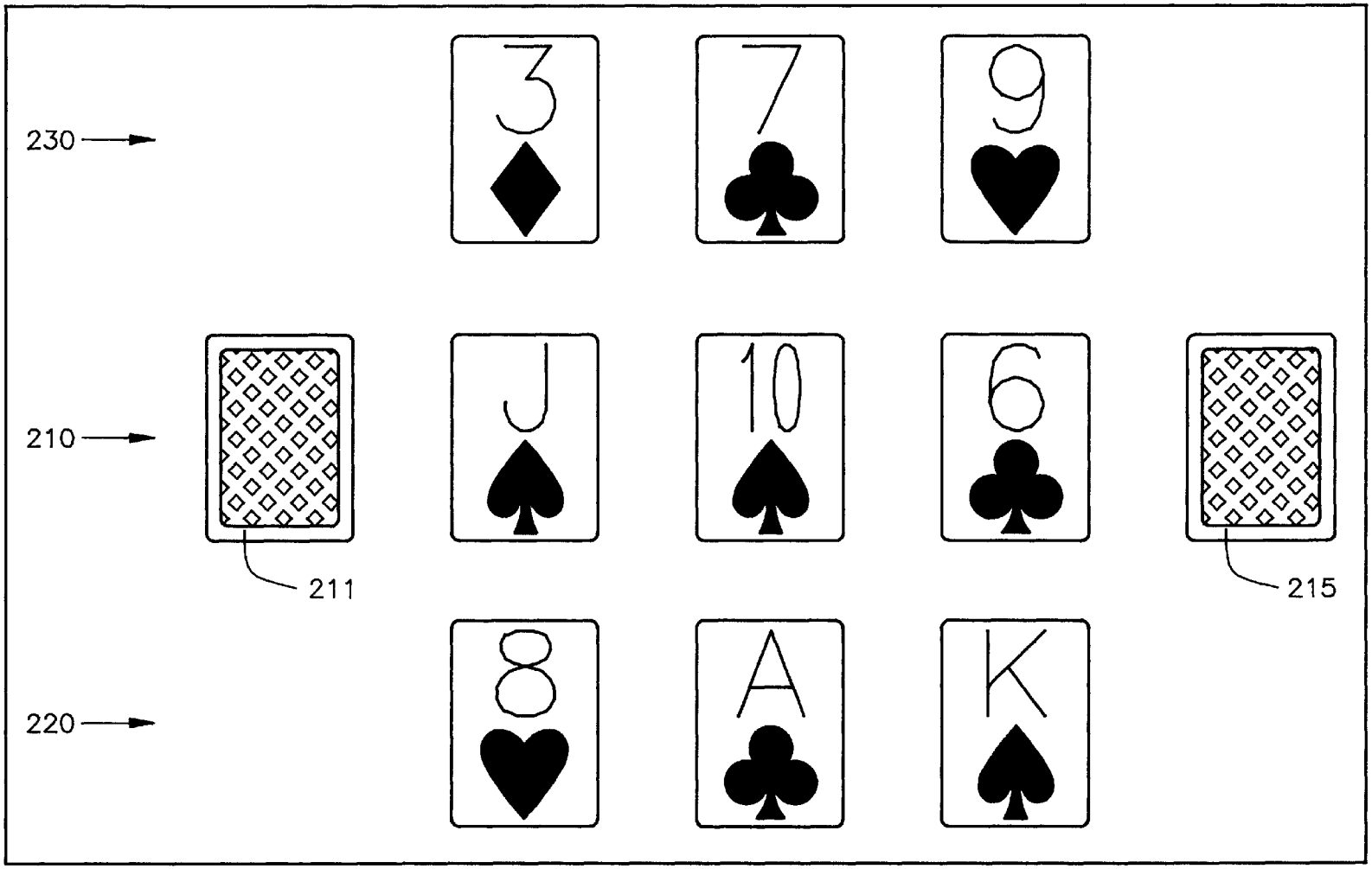
FIG. 9 shows the screen display for Version #2D after the initial deal of the cards.

Version #2D: This version plays the same as Version #2A. As shown in FIG. 9, the center row 210 has its two end cards 211 and 215 dealt face down. The bottom row 220 has only three cards, all dealt face up. The top row 230 also has only three cards, all dealt face up. After the player has chosen the replacement cards, the two face down end cards 171 and 175 are revealed. There are no replacement cards for the two ends cards 211 and 215 of the center row 210. This version gives the player full disclosure to select the best middle three hands, but the two end cards are left to chance.

Figure 10:
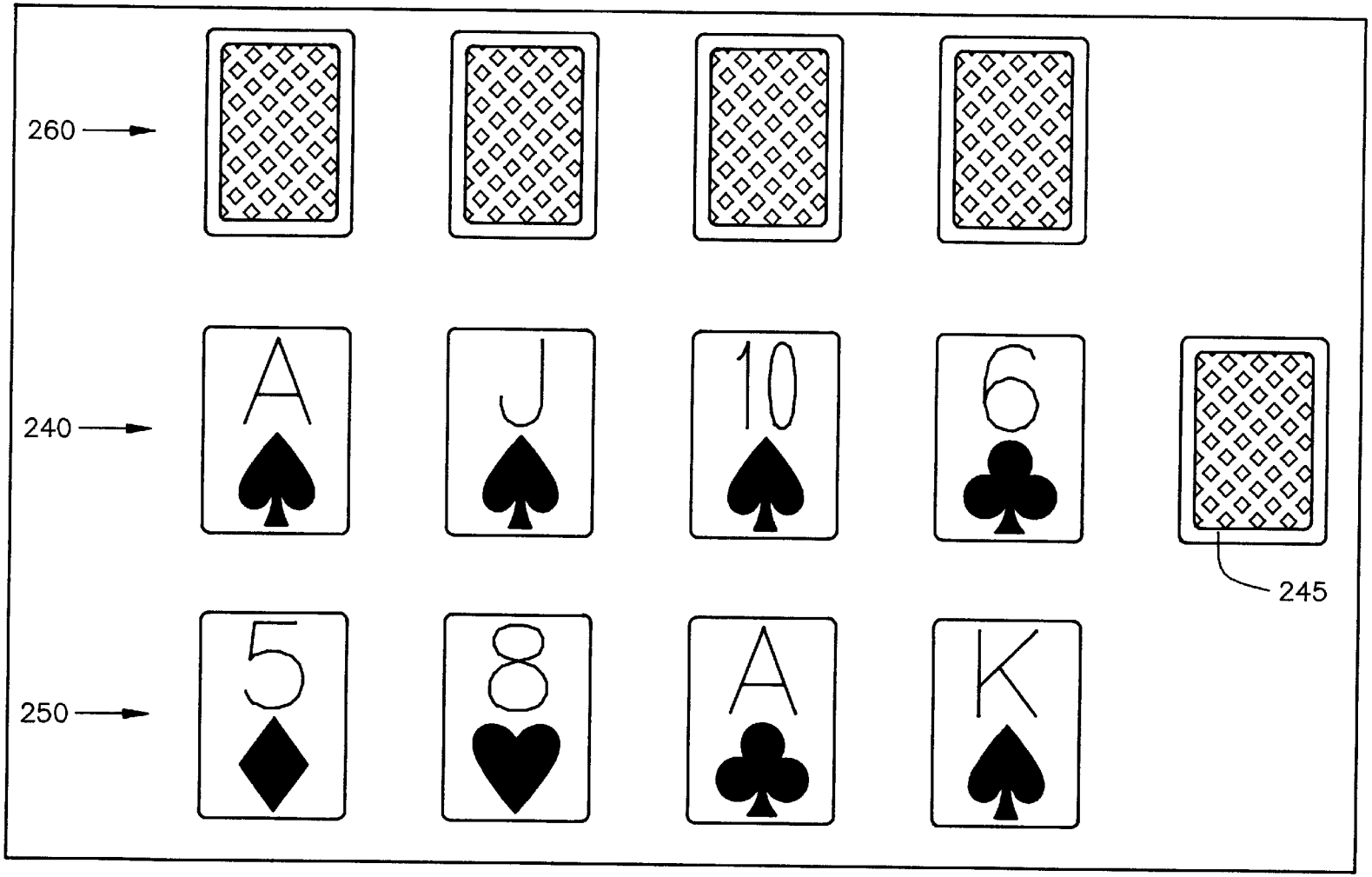
FIG. 10 shows the screen display for Version #2E after the initial deal of the cards.

Version #2E: This version again plays the same as Version #2A. The initial deal layout is shown in FIG. 10. The center row 240 has four face up cards and the fifth card 245 is dealt face down. The bottom row 250 has only four cards, all dealt face up and the top row 260 has only four cards, all dealt face down. There is no replacement card for the fifth center row card 245.

Figure 11:
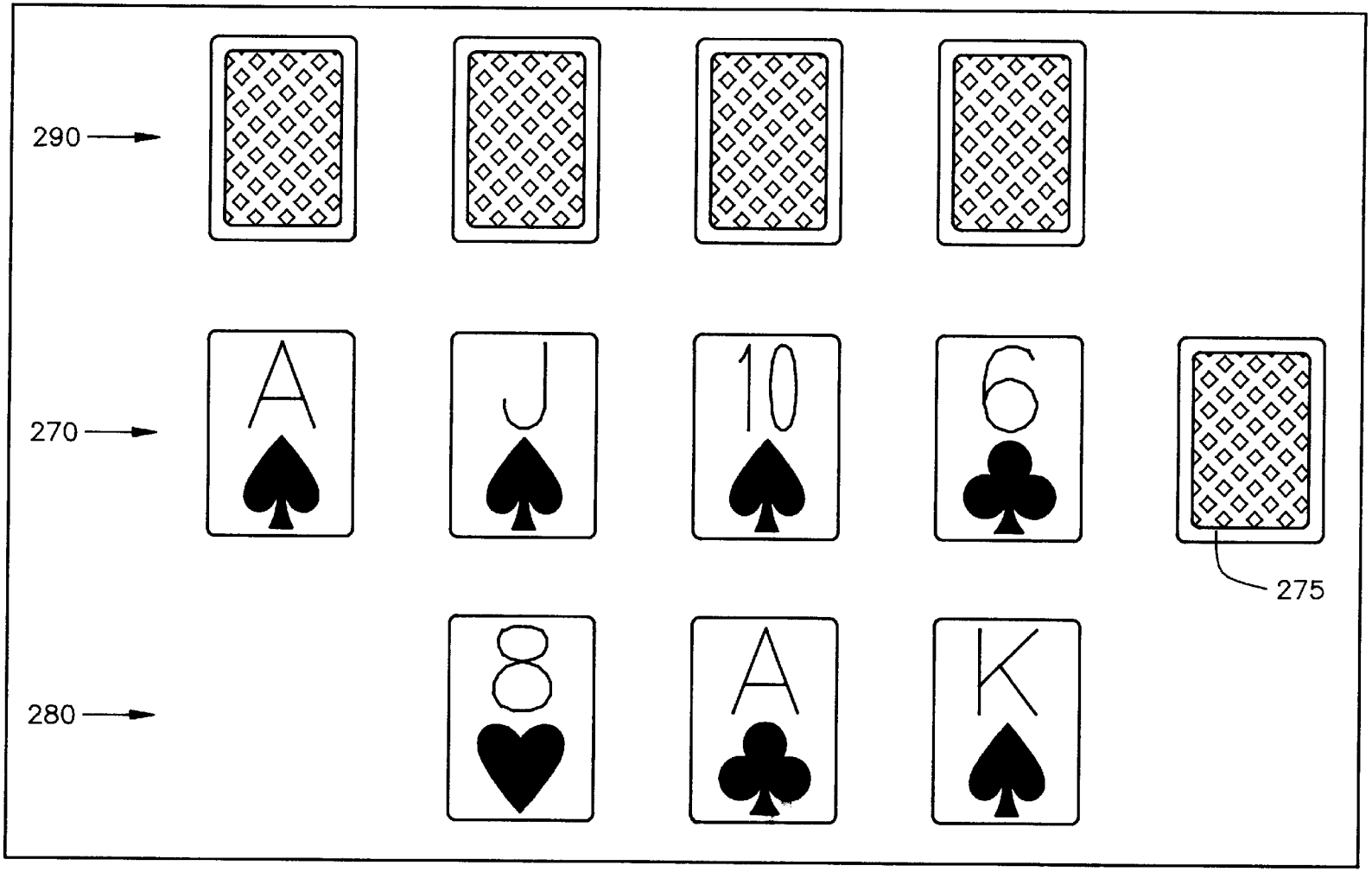
FIG. 11 shows the screen display for Version #2F after the initial deal of the cards.

Version #2F: This version also plays the same as Version #2A. The initial deal layout is shown in FIG. 11. The center row 270 has four face up cards and the fifth card 275 is dealt face down. The bottom row 280 has only three cards, all dealt face up and the top row 290 has only four cards, all dealt face down. There is no replacement card for the fifth center row card 275. This version gives the player less options for the replacement of cards.

Figure 12:
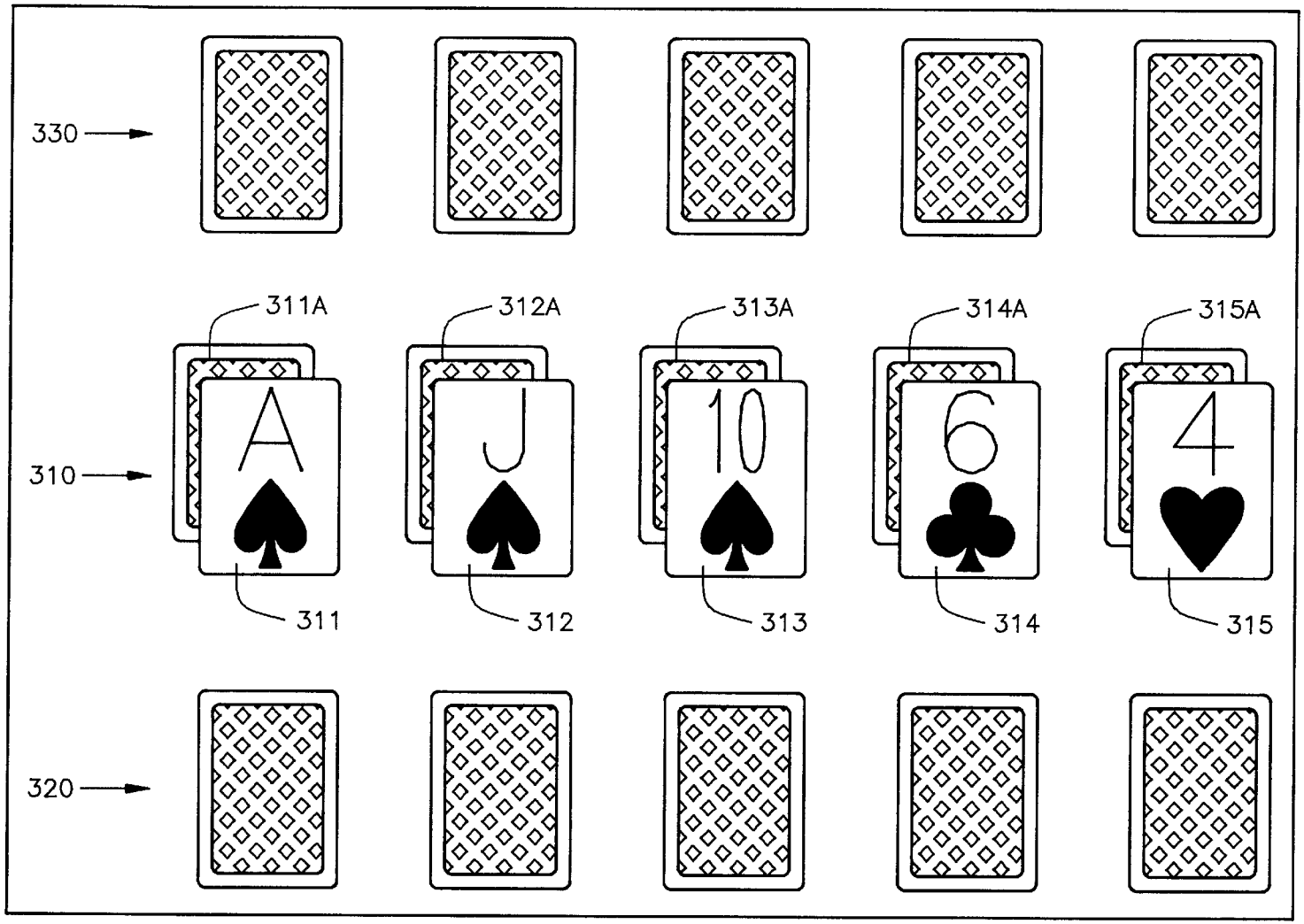
FIG. 12 shows the screen display for Version #2G after the initial deal of the cards.

Version #2G: This version is somewhat similar to Version #2A, but is more complicated. FIG. 12 shows the layout for the initial deal of this version. Three rows of cards are initially dealt. The center row 310 is dealt face up; the bottom row 320 and the top row 330 are dealt face down. Also, a face down card 311A, 312A, 313A, 314A and 315A is dealt underneath each of the respective face up cards 311, 312, 313, 314 and 315 in the center row 310.

The player makes one, two or three wagers: the first wager is on row 310, the second wager is on row 320 and the third wager is on row 330. Thus, the player is playing one, two or three hands at a time.

The player selects those cards in the center row 310 that he wishes to hold. The player effects this selection by pressing buttons or, using touch screen technology, by simply pressing the cards on the screen that the player wishes to hold. Each card that is held by the player from the center row 310 is duplicated in the corresponding vertically aligned position in both the bottom row 320 and the top row 330. Therefore, three copies of the held card are now displayed on the screen. The player may hold from zero to five cards from the center row 310.

Figure 13:
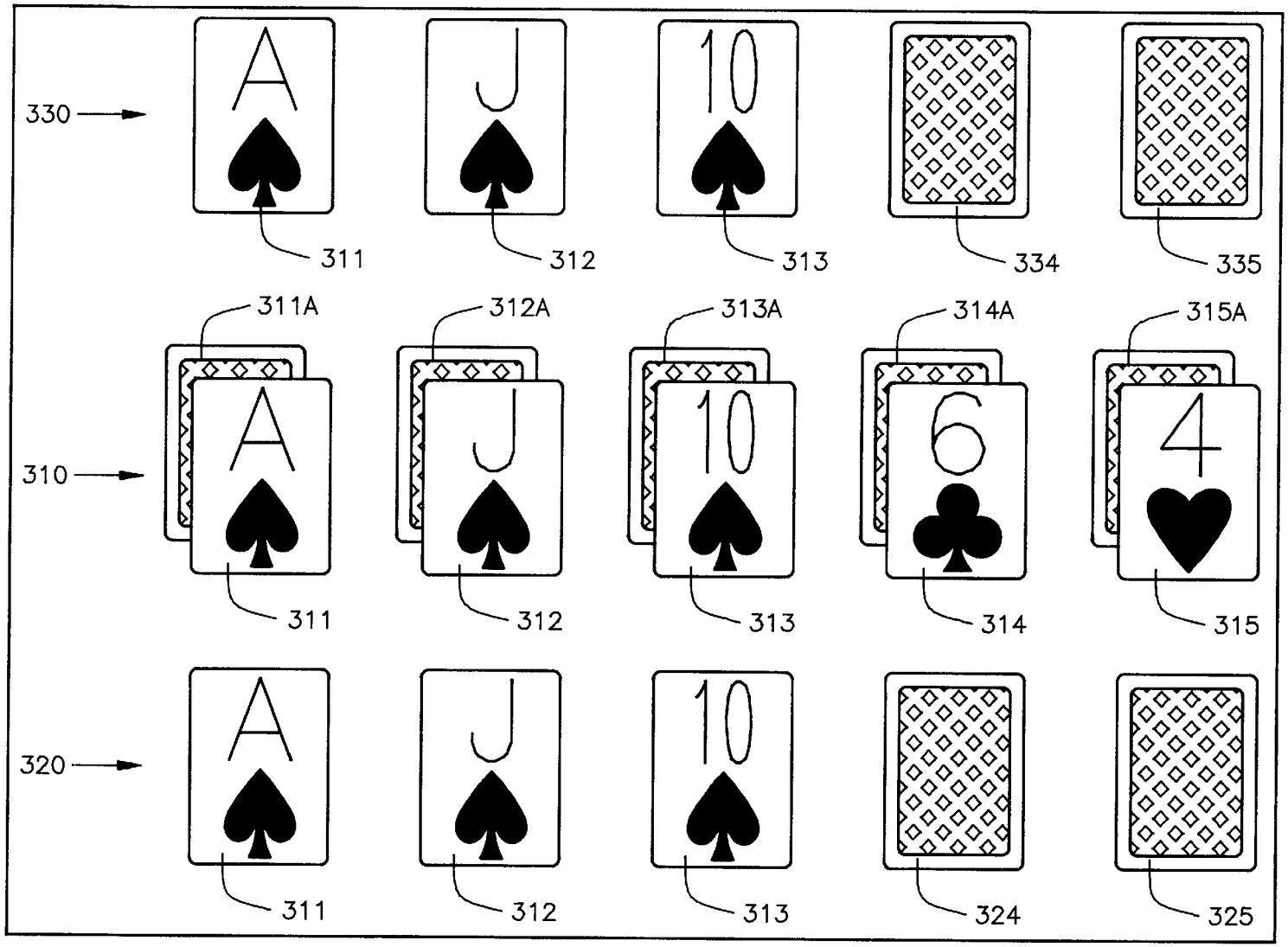
FIG. 13 shows the screen display for Version #2G after the player has selected the cards he wishes to hold from the center row.

FIG. 13 shows an example of the play of the hand when the player has held card 311, card 312 and card 313 from the center row 310. Card 311, the Ace of Spades, is duplicated in the same aligned position in top row 330 and in bottom row 320. Likewise, card 312, the Jack of Spades, and card 313, the Ten of Spades, are both duplicated in the same aligned positions in top row 330 and bottom row 320.

After the player is satisfied with his selection of replacement cards, the player presses the "deal" button and the two face down cards 324 and 325 in bottom row 320 are revealed. Similarly, the two face down cards 334 and 335 in top row 330 are revealed. The two unheld cards 314 and 315 in the center row 310 are replaced with the face down cards underneath them, cards 314A and 315A, and these two cards 314A and 315A are also revealed.

Each row is treated as a separate hand for payout purposes. Each row is evaluated for poker hand ranking and the player is paid based on the amount of his wager on each row depending on the poker hand ranking achieved for that row.

Thus, the player has effectively played three hands at once. The player could win on all three hands, could lose on all three hands, could win on two hands and lose on one hand or could lose on two hands and win on one hand.

In the preferred embodiment of this invention, the method of play uses a standard fifty-two card deck. One or more cards may also be designated as wild cards. If a player holds less than five cards from the center row, each hand will have different replacement cards so that player has the possibility of achieving various winning combinations. This game may also be dealt using three separate decks of cards—the first row being dealt using a first standard fifty-two card deck while the second row is dealt using a second deck of forty-seven cards which comprises a standard fifty-two card deck having the player's five initial face up cards shown in the first row omitted therefrom and the third row is dealt using a third deck of forty-seven cards which comprises a standard fifty-two card deck having the player's five initial face up cards shown in the first row omitted therefrom. This would allow the player, for example, to theoretically make three Royal Flushes at the same time.

Special bonus payouts can be added if the player achieves three high ranking hands at the same time. These bonus payouts could be fixed amounts or progressive payouts. For example, the player could win a progressive payout for achieving three Full Houses at the same time.

Figure 14:
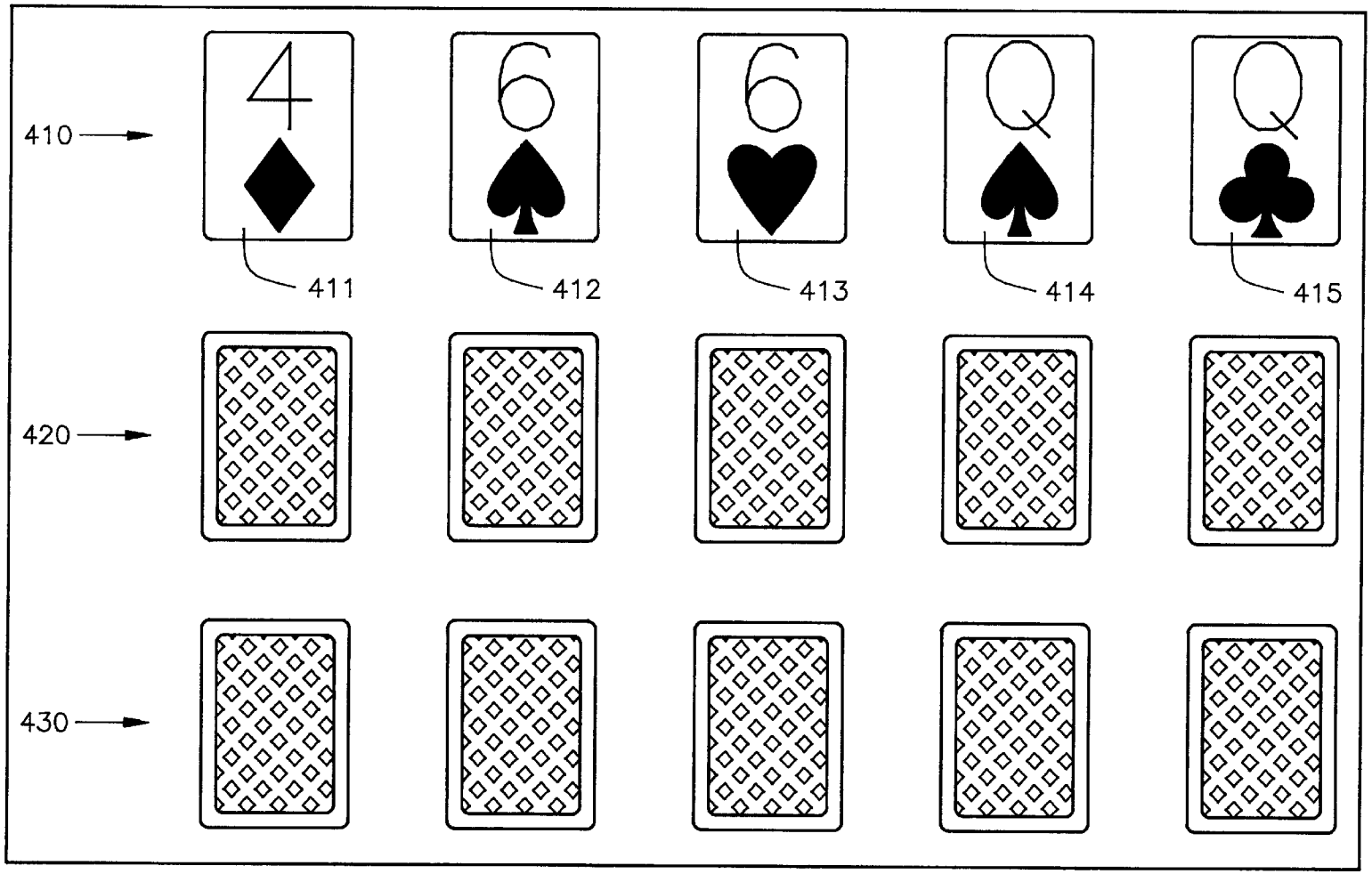
FIG. 14 shows the screen display for Version #2H after the initial deal of the cards.

Version #2H: This version is played similarly to Version #2G in that the player can play three hands at once, except for a modification to the manner in which the cards are dealt to the display screen. FIG. 14 shows the layout for the initial deal of this version. Three rows of cards are initially dealt. The top row 410 is dealt face up; the center row 420 and the bottom row 430 are dealt face down. Alternatively, any one of the three rows can be the face up cards with the other two rows being the face down cards.

In one embodiment of the present invention, the player has the option to make one, two or three wagers: the first wager is on row 410, the second wager is on row 420 and the third wager is on row 430. Thus, the player is playing one, two or three hands at a time. Alternatively, it could be mandatory that the player must wager on all three hands.

As shown in FIG. 14, the cards dealt to the top row 410 are the Four of Diamonds 411, the Six of Spades 412, the Six of Hearts 413, the Queen of Spades 414 and the Queen of Clubs 415.

The player selects those cards in the top row 410 that he wishes to hold. The player effects this selection by pressing buttons or, using touch screen technology, by simply pressing the cards on the screen that the player wishes to hold. Each card that is held by the player from the top row 410 is duplicated in the corresponding vertically aligned position in both the center row 420 and the bottom row 430. Therefore, three copies of each of the held cards are now displayed on the screen. The player may hold from zero to five cards from the top row 410.

Figure 15:
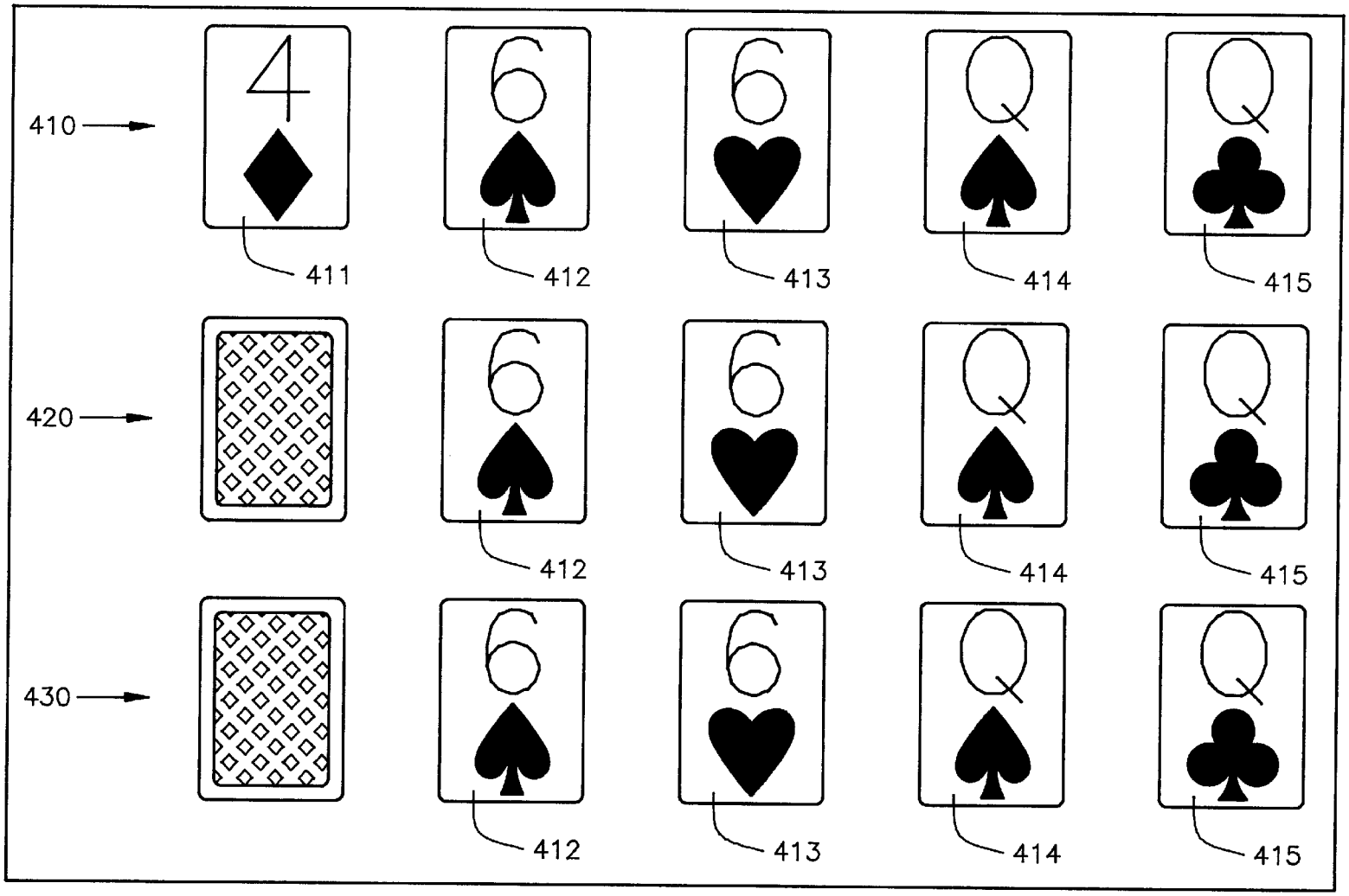
FIG. 15 shows the screen display for Version #2H after the player has selected the cards he wishes to hold from the top row and a replacement card has been dealt to the top row.

FIG. 15 shows an example of the play of the hand when the player has held card 412, card 413, card 414 and card 415 from the top row 410. Card 412, the Six of Spades, is duplicated in the same aligned position in center row 420 and in bottom row 430. Likewise, card 413, the Six of Hearts; card 414, the Queen of Spades; and card 415, the Queen of Clubs are also duplicated in the same aligned positions in center row 420 and bottom row 430.

Figure 16:
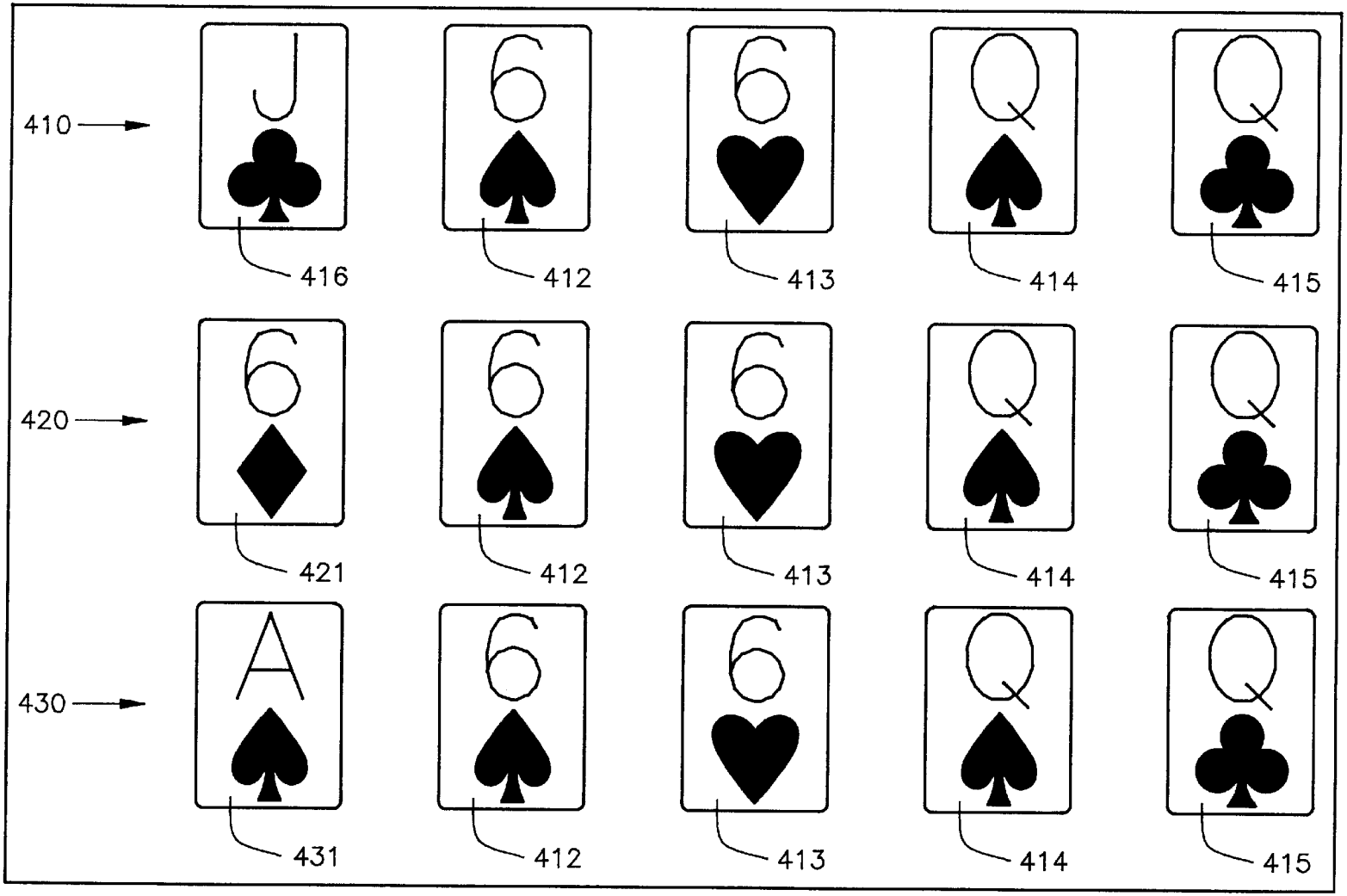
FIG. 16 shows the screen display for Version #2H after all three row have been completed and show five card hands.

After the player is satisfied with his selection of the held cards for each of the three hands, the player presses the "draw" button, the cards to be discarded are removed from the screen display and replacement cards are dealt for the discarded cards to complete each of the three hands. With regard to the hand in the top row 410, a replacement card is dealt for card 411 which was discarded by the player. As shown in FIG. 16, the new card is the Jack of Clubs 416 which does not improve the player's hand in the top row 410 which has a final hand ranking of Two Pair.

With regard to the hand in the center row 420, the last card 421 added to this hand is the Six of Diamonds giving the hand in the center row 420 a final hand ranking of a Full House. With regard to the hand in the bottom row 430, the last card 431 added to this hand is the Ace of Spades giving the hand in the bottom row a final hand ranking of Two Pair.

Each row is treated as a separate hand for payout purposes. Each row is evaluated for poker hand ranking and the player is paid based on the amount of his wager on each row depending on the poker hand ranking achieved for that row. A suitable pay table is provided as is conventional for electronic video poker games with the amount of the player's winnings being based on the poker hand ranking achieved and the amount wagered by the player on each hand.

In the preferred embodiment of this version of the present invention, the amount of the player's wager on each hand would be the same. Alternatively, the player could be allowed to make wagers of different amounts on each hand.

Thus, the player has effectively played three hands at once. The player could win on all three hands, could lose on all three hands, could win on two hands and lose on one hand or could lose on two hands and win on one hand.

In the preferred embodiment of this invention, the game is dealt using three separate decks of cards—the first row being dealt using a first standard fifty-two card deck while the second row is dealt using a second deck of forty-seven cards which comprises a standard fifty-two card deck having the player's five initial face up cards shown in the first row omitted therefrom and the third row is dealt using a third deck of forty-seven cards which comprises a standard fifty-two card deck having the player's five initial face up cards shown in the first row omitted therefrom. This would allow the player, for example, to theoretically make three Royal Flushes (or any other three hands of the same rank) at the same time. This is accomplished using the computer controls that operate the gaming machine with the software being written so that the second and third decks used to deal the second and third hands, respectively, have removed therefrom the five cards initially dealt.

Alternatively, the method of play can also use only one standard fifty-two card deck. In this alternative, each of the three rows will receive different replacement cards from the deck for those cards that are discarded. For example, if a player holds less than five cards from the top row 410, each hand will receive different replacement cards so that player has the possibility of achieving various winning combinations.

In either the multiple deck embodiment or the single deck embodiment, one or more cards may alternatively be designated as wild cards or one or more Jokers may be added to the deck or decks and designated as wild cards. This allows the methods of the present invention to be applied to any of the various wild card video poker games that are known in the art, such as Deuces Wild or Joker's Wild.

Special bonus payouts can be added if the player achieves, either on the deal or after the draw, three hands of the same rank at the same time. These bonus payouts could be fixed amounts or progressive payouts. For example, the player could win a progressive payout for achieving three Full Houses at the same time. As another example when three decks are used, the player can receive a large fixed or progressive payout if the player achieves the same poker hand in each of the three rows—such as a Royal Flush in Spades in all three rows.

Another alternative to Version #2H would be to reduce the three rows shown to only two rows and otherwise practice the method of this version as described. The player would make two wagers to play the two rows and select the cards initially dealt that would be used in each of the two rows. Replacement cards would be provided to complete the hands in each of the two rows and winning and losing hands would be determined in the same manner as described above with reference to the three rows.

Likewise, the method of play described in Version #2H could also be modified by increasing the number of rows to four or more, with five rows being the preferred number of rows for this alternative. Again if four or more rows are used, the method of play would be the same as that described above with reference to the three rows version. In order to show four or more rows of cards at the same time on a video screen display, a larger video monitor may be required.

Figure 17:
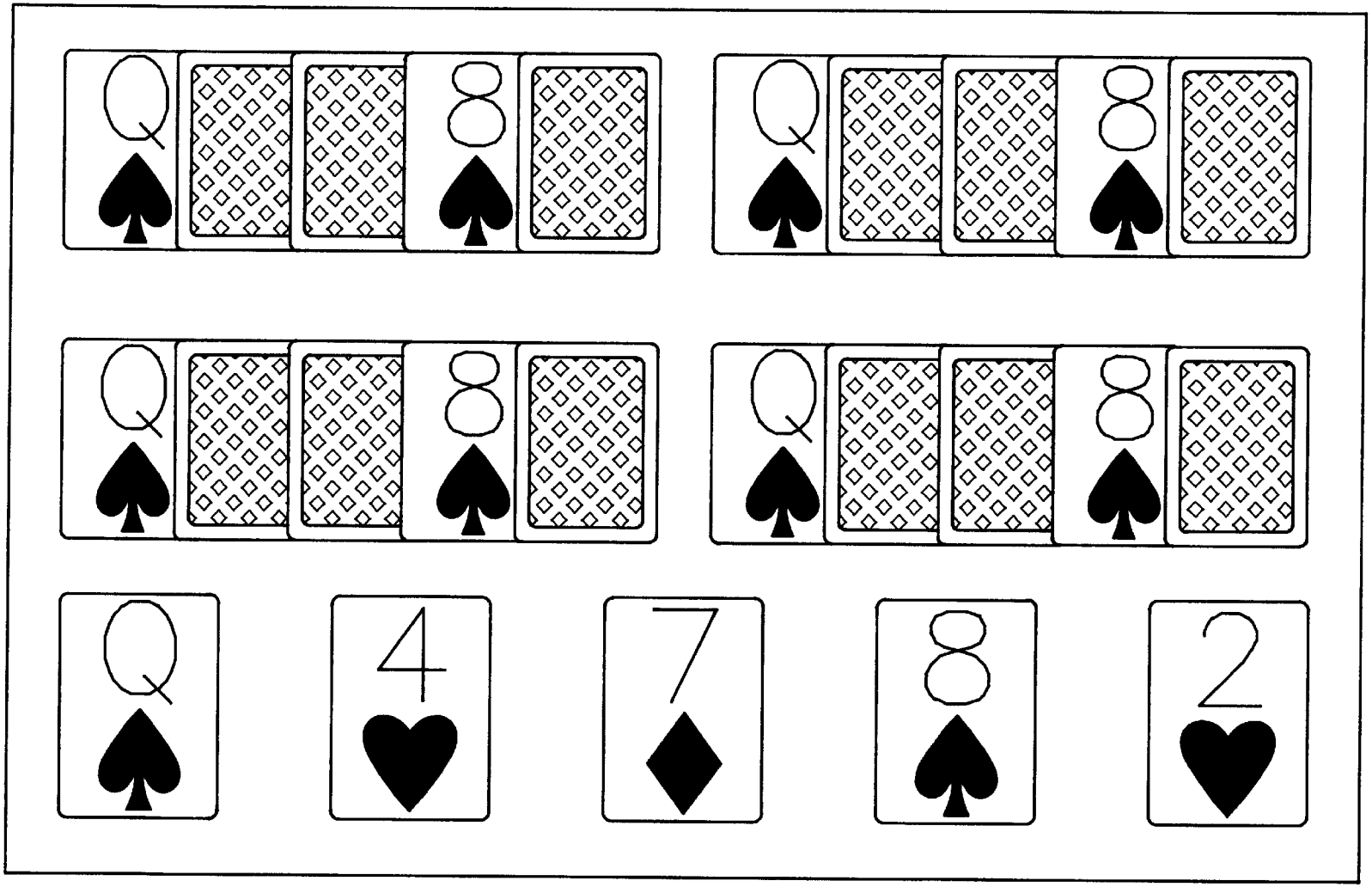
FIG. 17 shows the screen display for Version #2H which uses five rows of cards after the initial deal of the cards.

For example, FIG. 17 shows a screen display with five rows. The player makes appropriate wagers on one or more rows. The lowermost row is displayed first with all five cards face up. The player selects which cards he wishes to hold from the lowermost row and these cards are duplicated into all of the other rows on which the player has wagered. Replacement cards are dealt for the unselected cards in the lowermost row and additional cards are provided to complete each five card hand in the other rows. In one embodiment of this five row version, a single deck of cards can be used for all of the rows.

However, the preferred embodiment of this version uses five separate decks of cards—the first row being dealt using a first standard fifty-two card deck while the second, third, fourth and fifth rows are dealt using separate decks of forty-seven cards which comprises a standard fifty-two card deck having the player's five initial face up cards shown in the first row omitted therefrom. This would allow the player, for example, to theoretically make five Royal Flushes (or any other five card hands of the same rank) at the same time. This is accomplished using the computer controls that operate the gaming machine with the software being written so that the additional separate decks used to deal the additional hands have removed therefrom the five cards initially dealt in the first row.

Figure 18:
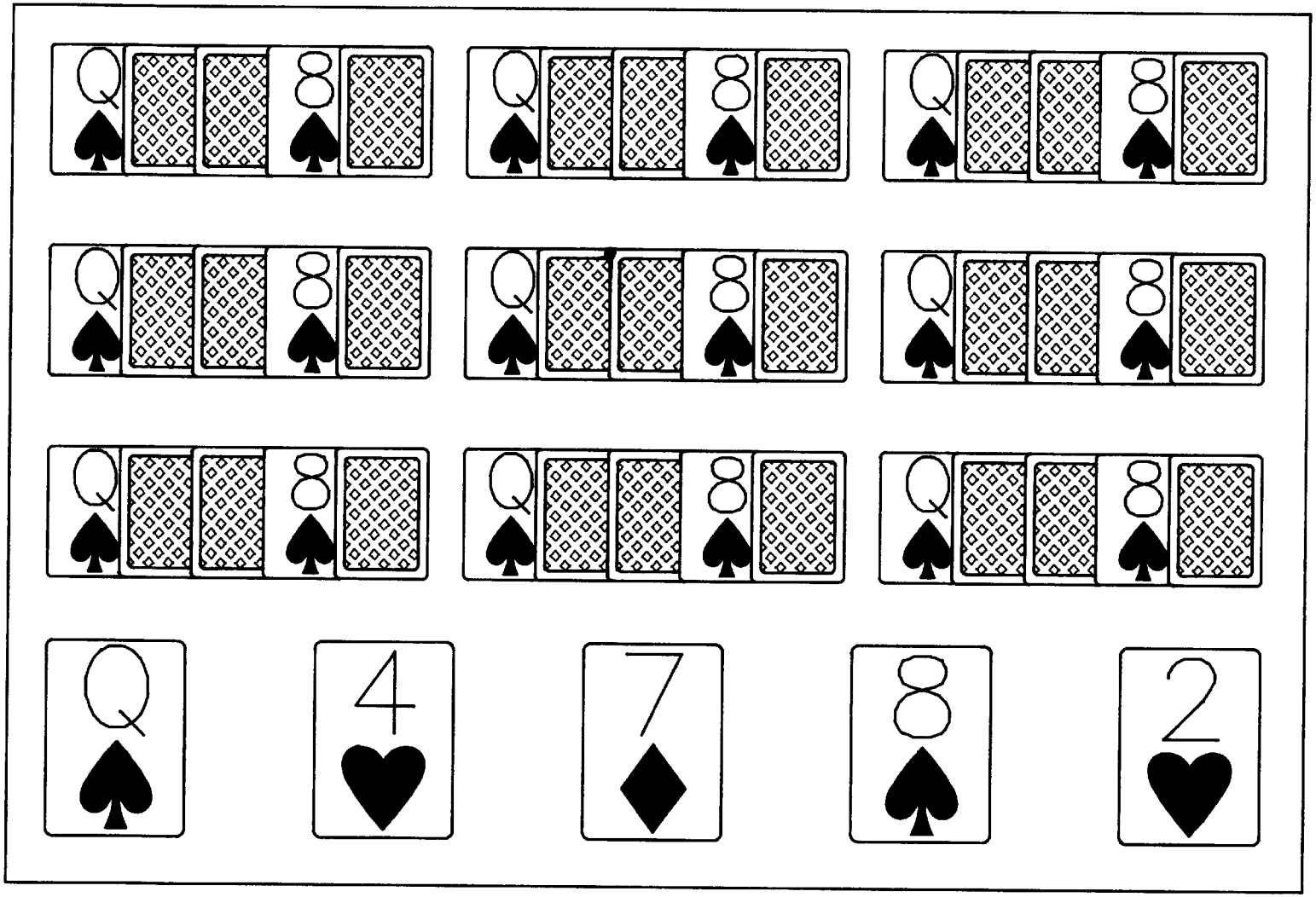
FIG. 18 shows the screen display for Version #2H which uses ten rows of cards after the initial deal of the cards.

FIG. 18 shows another initial row display in which ten rows of cards are displayed to the player. The player makes appropriate wagers on one or more rows up to a total of ten rows to play all ten rows. Again, the lowermost row is displayed first with all five cards face up. The player selects which cards he wishes to hold from the lowermost row and these cards are duplicated into all of the other rows on which the player has wagered. Replacement cards are dealt for the unselected cards in the lowermost row and additional cards are provided to complete each five card hand in the other rows. In one embodiment of this ten row version, a single deck of cards can be used for all of the rows.

However, the preferred embodiment of this version uses ten separate decks of cards—the first row being dealt using a first standard fifty-two card deck while the second through tenth rows are dealt using separate decks of forty-seven cards which comprises a standard fifty-two card deck having the player's five initial face up cards shown in the first row omitted therefrom. This would allow the player, for example, to theoretically make ten Royal Flushes (or any other five card hands of the same rank) at the same time. This is accomplished using the computer controls that operate the gaming machine with the software being written so that the additional separate decks used to deal the additional hands have removed therefrom the five cards initially dealt in the first row.

Figure 19:
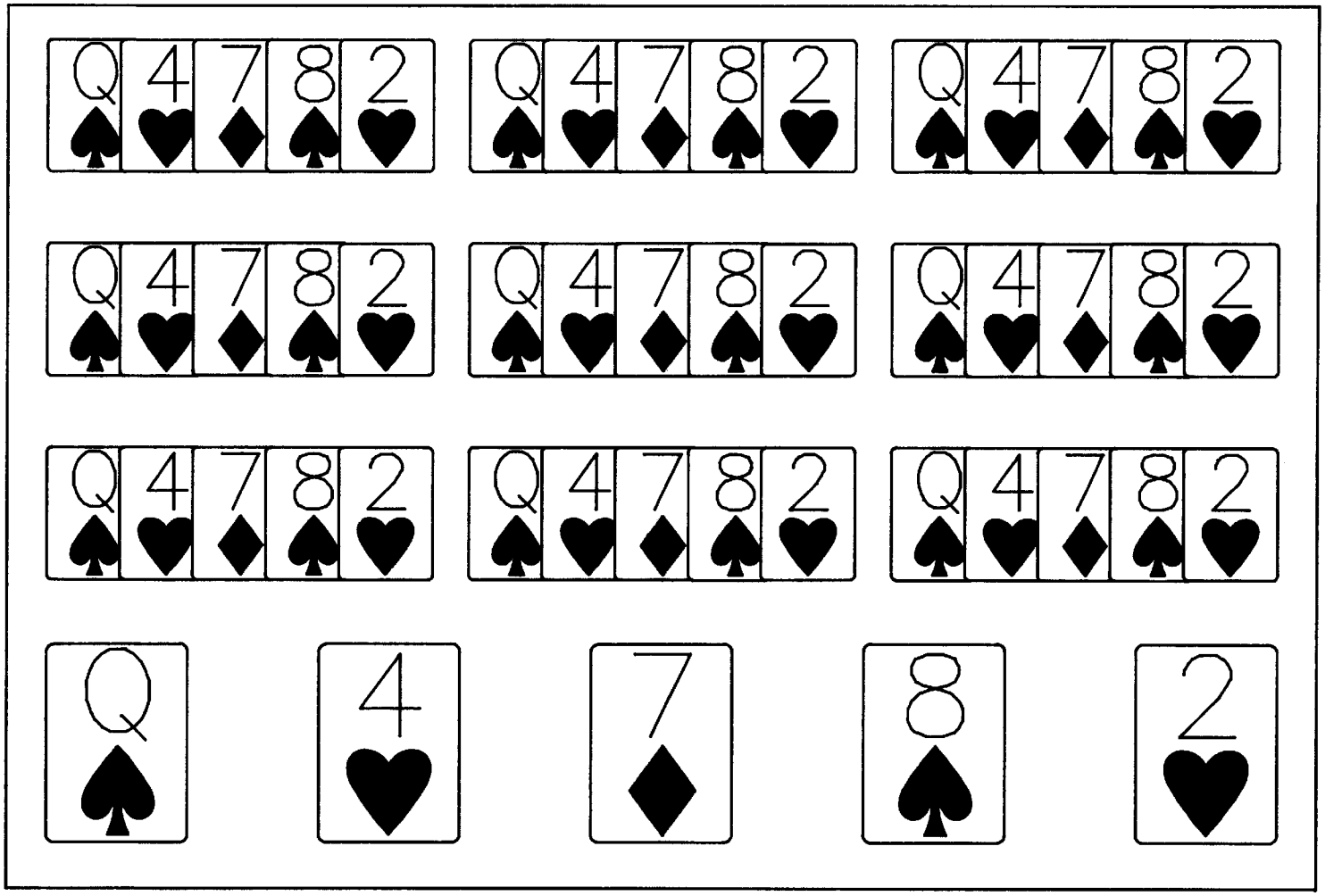
FIG. 19 shows the screen display for Version #2H which uses ten rows of cards after the initial deal of cards in which all of the rows have the same cards displayed face up.

FIG. 19 shows a different way of displaying the ten rows. When the initial lowermost row is dealt, all five of the face up cards from this initial row are also displayed in the other nine rows. The player selects which cards he wishes to hold from the lowermost row and these cards are automatically held in all of the other rows on which the player has wagered. Replacement cards are dealt for the unselected cards in the lowermost row and all of the other rows. The game otherwise proceeds as described in connection with FIG. 18. Either a single deck of cards or ten separate decks of cards are used.

In order to adopt this alternative of four or more rows of cards to the smaller video monitors often used in video poker gaming machines, the display of the play of this method can be modified. The player would initially make a multiple coin or credit wager representing the number of rows that the player wishes to play during that round of the game. The minimum number of coins or credits wagered would be two with the maximum being any number desired. A first hand of five cards would initially be dealt to the player. The player would select which of five cards, if any, the player wishes to hold and then replacement cards would be dealt for the discarded cards. The winning or losing outcome of this first hand would then be determined.

For the second hand, the cards held by the player from the first hand would then be redisplayed on the video screen and additional cards would be dealt to complete the player's second hand. Again, the winning or losing outcome of this second hand would be determined. The steps of redisplaying the held cards from the first hand and the dealing of cards to complete the hand would be repeated for each wager made by the player until the total number of hands originally wagered by the player is completed. This seriatim method of play can be applied whenever two or more rows are desired to be played.

In this seriatim alternative method of play, each hand is completed by using a separate deck of cards (which have the first five cards removed therefrom so as to eliminate the possibility of duplicated cards being dealt as replacement cards) or by reshuffling the remaining forty-seven cards before each new row is played. Alternatively, a single deck of cards can be used as the source for both the initial five cards and the additional cards used to complete each of the multiple hands.

Version #2I: In this version, fifteen cards are dealt and displayed on the screen. These fifteen cards are dealt in three rows of five cards each. The player then proceeds to play three separate five card hands—each row being a separate hand. The player selects which cards to hold and discard from each row. After the player has completed this selection, the player presses the "deal" button and replacement cards are dealt and displayed. Each row is then determined for poker hand ranking and the player wins according to the pay table based on the amount wagered for each row. The player has the advantage of seeing fifteen cards prior to holding and discarding, so the player knows which cards from the deck will not be available as replacement cards on the draw.

One modification to these versions involves the addition of a bonus round which the player earns based on achieving certain hand combinations. If the player qualifies for a bonus round, the player is dealt five cards at random from the deck. Each card is initially displayed on the video screen face down and are turned over one at a time. The player is paid if this bonus hand qualifies for the bonus award pay table. A jackpot, which is either fixed amount or a progressive jackpot, can be paid for a Royal Flush or even a sequential Royal Flush.

Alternatively, the bonus round may be dealt at the end of or during every round of the game giving the player a chance to win the bonus payout each round of the game. Further, the bonus round may require the player to make an additional wager to participate.

Other modifications may be made to the method of play of these versions which differ only in the number of rows of cards. These versions can be played using two, four or five rows on five cards each. An example of one of these modifications would be Version #2J.

Version #2J. This version is played similar to either Version #2G or Version #2H, except that there are two additional rows of face down cards. Thus, there are a total of five rows of cards with only the center row being face up on the initial deal. As in Version #2G, the center row also has an underlying row of face down cards on the initial deal.

The play of this version is essentially the same as Version #2G except that the player is now effectively playing five hands of video poker at the same time instead of only three hands at a time as in Version #2G. Each card that the player selects to be held is duplicated into the two face down rows directly below the held card as well as the two face down rows directly above the held card.

The method of play of this Version #2J also creates additional five card stud hands of replacement cards in each of the vertical columns. Special payouts or progressive or non-progressive jackpots may be awarded for high ranking stud hands that may be formed in these vertical columns such as a Full House, a Royal Flush or even a sequential Royal Flush.

Figure 20:
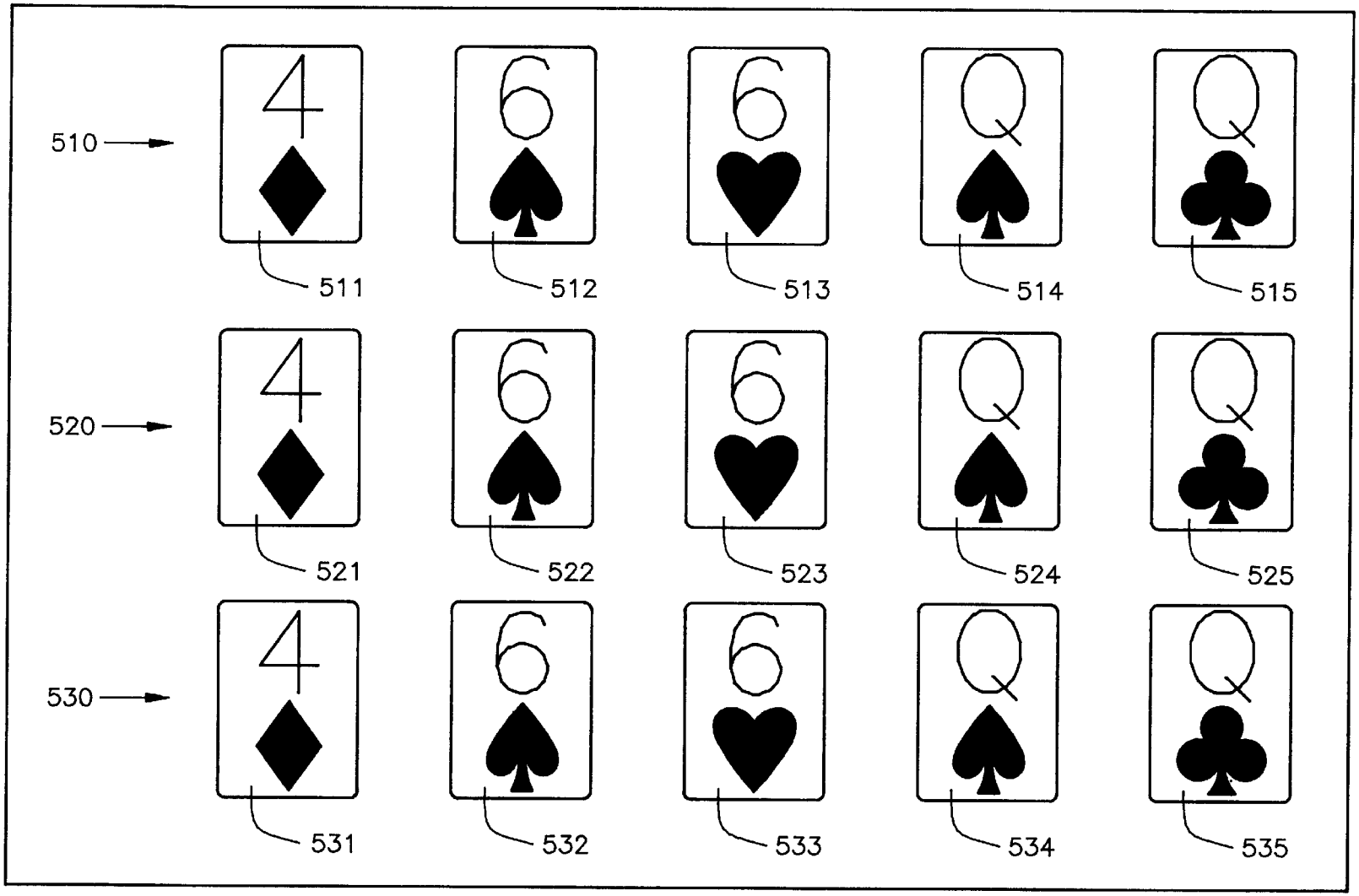
FIG. 20 shows the screen display for Version #2K of the present invention after the initial deal of the cards.

Version #2K. Another alternative method of play of the present invention would have two or more rows of five or more cards all dealt face up with each row having the same cards shown face up. In the preferred embodiment of this version #2K, three rows are displayed face up with each row having the same five cards shown in each hand. As shown in the example in FIG. 20, row 510 is dealt with five cards—the Four of Diamonds 511, the Six of Spades 512, the Six of Hearts 513, the Queen of Spades 514 and the Queen of Clubs 515; row 520 is dealt with five cards—the Four of Diamonds 521, the Six of Spades 522, the Six of Hearts 523, the Queen of Spades 524 and the Queen of Clubs 525; and row 530 is dealt with five cards—the Four of Diamonds 531, the Six of Spades 532, the Six of Hearts 533, the Queen of Spades 534 and the Queen of Clubs 535. The player can then select which cards to hold from any one of the rows and these cards selected by the player are automatically held in the other two rows. Again with reference to the example shown in FIG. 17, the player would most likely hold the Six of Spades, the Six of Hearts, the Queen of Spades and the Queen of Clubs. Whichever cards are selected by the player will automatically be held in each of the rows.

Each row then receives replacement cards for the cards that are discarded, preferably from separate decks for each row. The player has three final five card hands and wins or loses on each hand separately based on a pay table which shows the winning hand combinations. If the player has a winning hand, the amount won by the player is based on the amount wagered by the player on that particular row and the poker hand ranking of the cards in that row.

Figure 21:
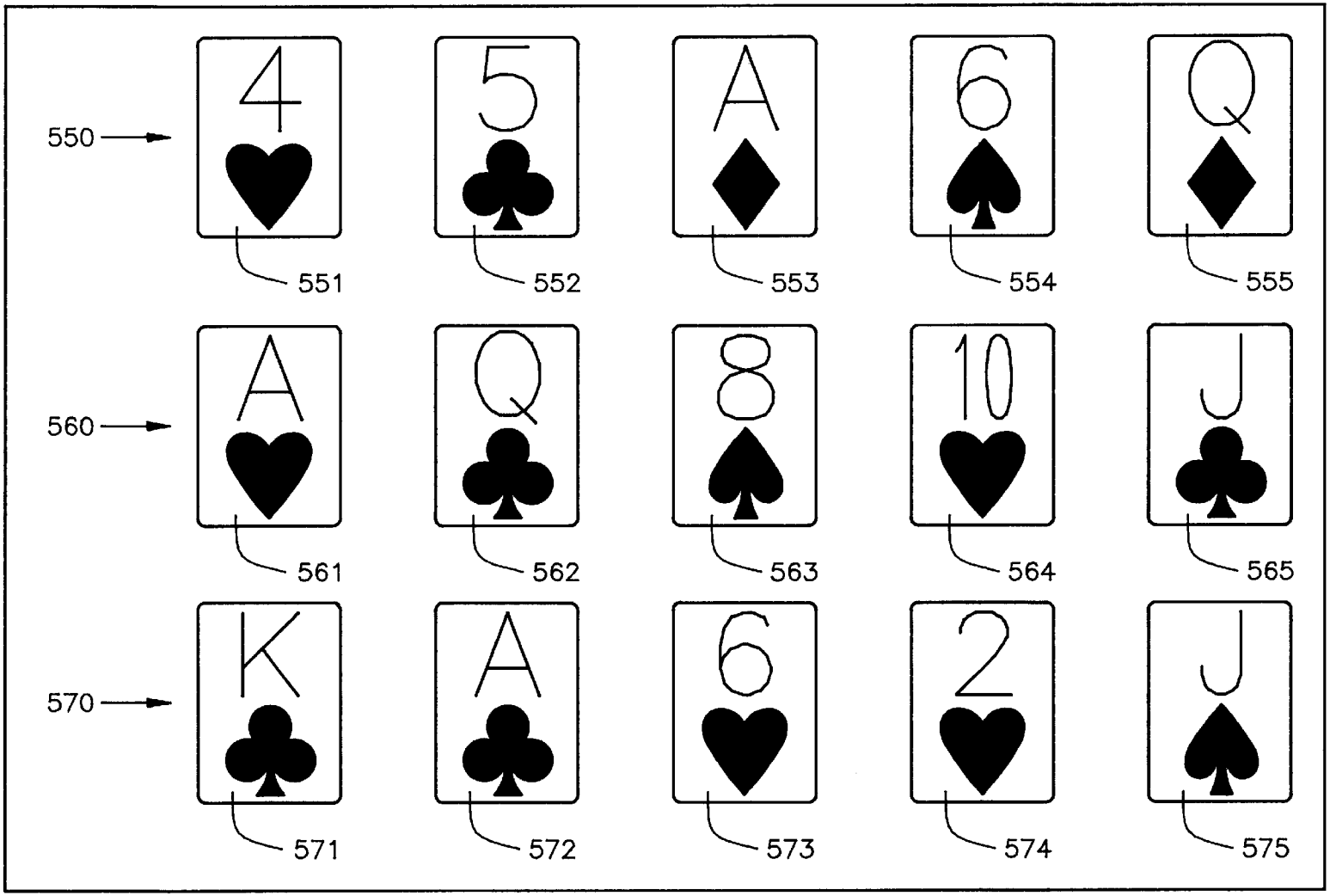
FIG. 21 shows the screen display for Version #2L of the present invention after the initial deal of the cards.

Version #2L. Another alternative method of play of the present invention would have two or more rows of five or more cards all dealt face up from a single deck of cards so that each row is dealt having different cards shown face up. In the preferred embodiment of this version #2L, three rows are displayed face up with each row having different five card hands. Each card in the first row is vertically aligned in a column with adjacent cards in the other rows. As shown in the example in FIG. 21, row 550 is dealt with five cards—the Four of Hearts 551, the Five of Clubs 552, the Ace of Diamonds 553, the Six of Spades 554 and the Queen of Diamonds 555; row 560 is dealt with five cards—the Ace of Hearts 561, the Queen of Clubs 562, the Eight of Spades 563, the Ten of Hearts 564 and the Jack of Clubs 565; and row 570 is dealt with five cards—the King of Clubs 571, the Ace of Clubs 572, the Six of Hearts 573, the Two of Hearts 574 and the Jack of Spades 575. The player can then select which cards to hold from any one of the rows (but only one card may be selected from any vertical column) and these cards selected by the player are automatically held in the other two rows. Again with reference to the example shown in FIG. 21, the player would most likely hold the Ace of Hearts 561 from row 560, the Ace of Diamonds 553 from row 550 and the Ace of Clubs 572 from row 570. Whichever cards are selected by the player will automatically be held in each of the other two rows. In this example, the player ends up with three rows each having three Aces. All other cards are discarded.

Each row then receives replacement cards for the cards that are discarded, preferably from separate decks for each row. The player has three final five card hands and wins or loses on each hand separately based on a pay table which shows the winning hand combinations. If the player has a winning hand, the amount won by the player is based on the amount wagered by the player on that particular row and the poker hand ranking of the cards in that row.

In another variation of this Version #2L, the player is dealt three rows of cards from a single deck as described above in connection with the basic method of Version #2L. Each row will have different cards. However, instead of the player selecting cards from any row, the player first selects one of the rows to play—but in can be any row displayed. For example with reference again to FIG. 21, the player could select either row 550, 560 or 570, but only one of those rows. The selected row of cards is duplicated into the other two rows. The player then selects none, one or more of the face up cards from any one of the rows as cards to be held and the selected cards are then held in the other rows. Unselected cards are then discarded.

Each row then receives replacement cards for the cards that are discarded, preferably from separate decks for each row. The player has three final five card hands and wins or loses on each hand separately based on a pay table which shows the winning hand combinations. If the player has a winning hand, the amount won by the player is based on the amount wagered by the player on that particular row and the poker hand ranking of the cards in that row.

In addition to five card rows, the method of the present invention can also be applied to six, seven or more card rows. Winning hand combinations can be based on six card poker hand, seven card poker hands or even more card poker hands. Alternatively, the winning hand combinations can be based on the best five card poker hand out of the six, seven or even more cards in the row.

DOUBLE DOWN STUD® Poker Version

The concepts of the present invention can also be applied to a casino game known as DOUBLE DOWN STUD® poker. This game is described in U.S. Pat. No. 5,100,137 and U.S. Pat. No. 5,167,413, the disclosures of each of which are incorporated herein by this reference. In DOUBLE DOWN STUD® poker, the player makes a first wager and is dealt four cards all face up. The player may make an additional wager prior to receiving the fifth card. After the fifth card is dealt, the five card hand is compared to a pay table to determine if the player has a winning or losing card combination based on poker hand ranking.

In the present invention, the player makes a separate wager for each row that the player wishes to play. The player is dealt four cards face up and a fifth card face down for each row that the player has made a wager. Each row has the same four cards as the face up cards.

If the face down cards are dealt from the same deck, each fifth face down card is different. If the face down cards are dealt each from its own deck (after the initial four face up cards have been removed), then each fifth face down card could or could not be the same.

Figure 22:
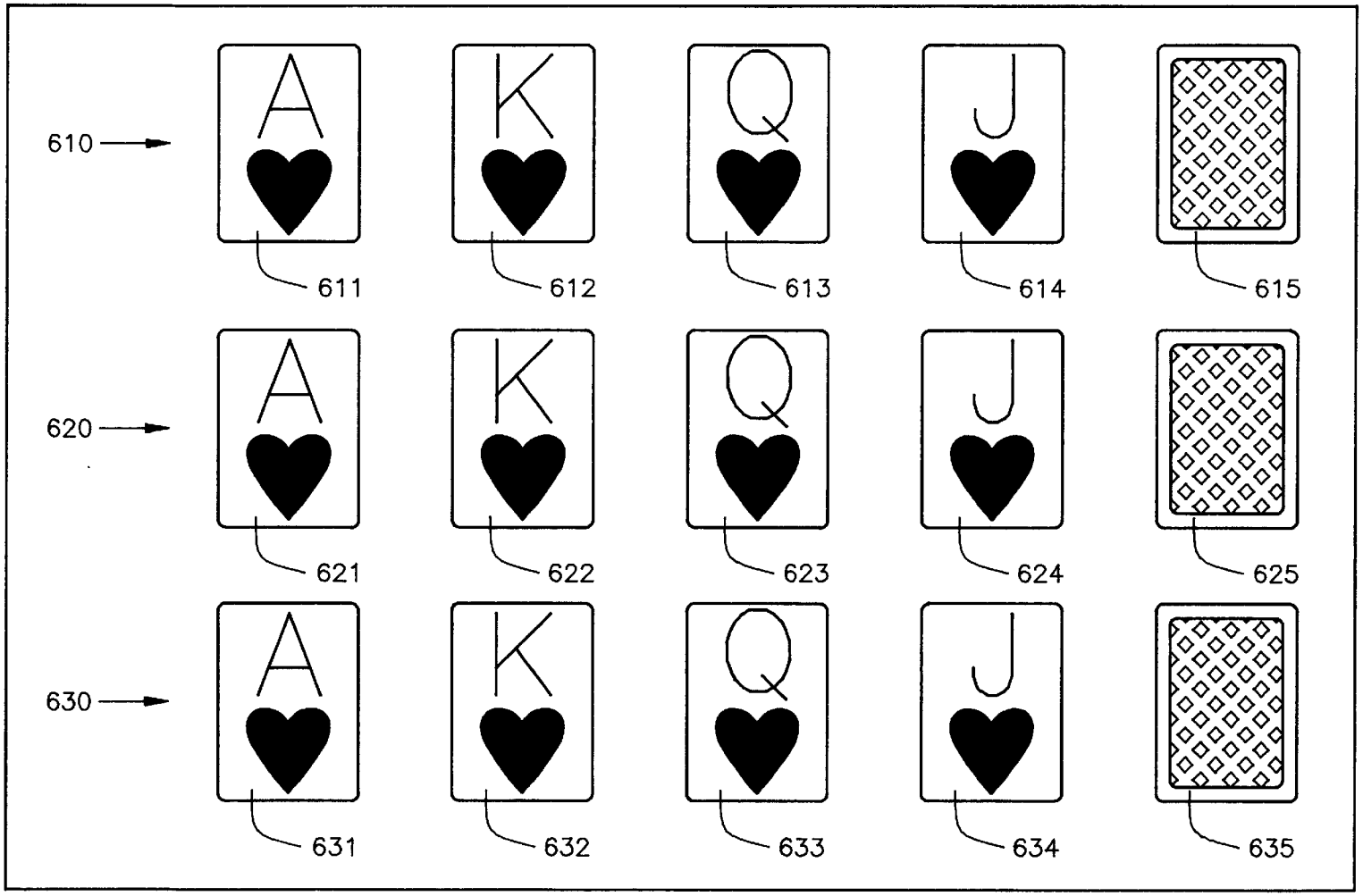
FIG. 22 shows the screen display for the DOUBLE DOWN STUD® version of the present invention after the initial deal of the cards.

As shown in FIG. 22, the preferred embodiment of this version uses three rows and the player has made a wager on each of the three rows. For example, the player has been dealt in row 610 the Ace of Hearts 611, the King of Hearts 612, the Queen of Hearts 613, the Jack of hearts 614 and a fifth card face down. Two more rows of identical face up cards are dealt—row 620 with the Ace of Hearts 621, the King of Hearts 622, the Queen of Hearts 623, the Jack of Hearts 624 and a fifth card face down and row 630 with the Ace of Hearts 631, the King of Hearts 632, the Queen of Hearts 633, the Jack of Hearts 634 and a fifth card face down.

The player then decides whether to double his wager on each row. Then the fifth card in each row is displayed face up and the player wins or loses on each row depending on the poker hand ranking of the five cards. Winning hands are paid based on a pay table and the amount of the player's wager.

Multi-Hand Stud Version #3

The present invention also includes multi-hand stud poker methods of play in which at least four rows of stud poker hands are dealt to the player.

Version #3A

In this version #3A, at least four rows of five cards hands are dealt to the player, each row being dealt from its own deck of cards. Prior to the deal, the player makes a wager on the bottommost row and then all four rows are dealt. The bottommost row has one card face up and four cards face down. The next row has two cards face up (with the face up card from the previous row duplicated into this row) and three cards face down. The next row has three cards face up (with the two face up cards from the previous row duplicated into this row) and two cards face down. The top row has four cards face up (with the three face up cards from the previous row duplicated into this row) and one card face down.

If the face down cards are dealt from the same deck, each face down card is different. If the face down cards for each row are dealt each from its own deck (after the face up cards have been removed), then the face down cards in each row could or could not repeat.

Figure 23:
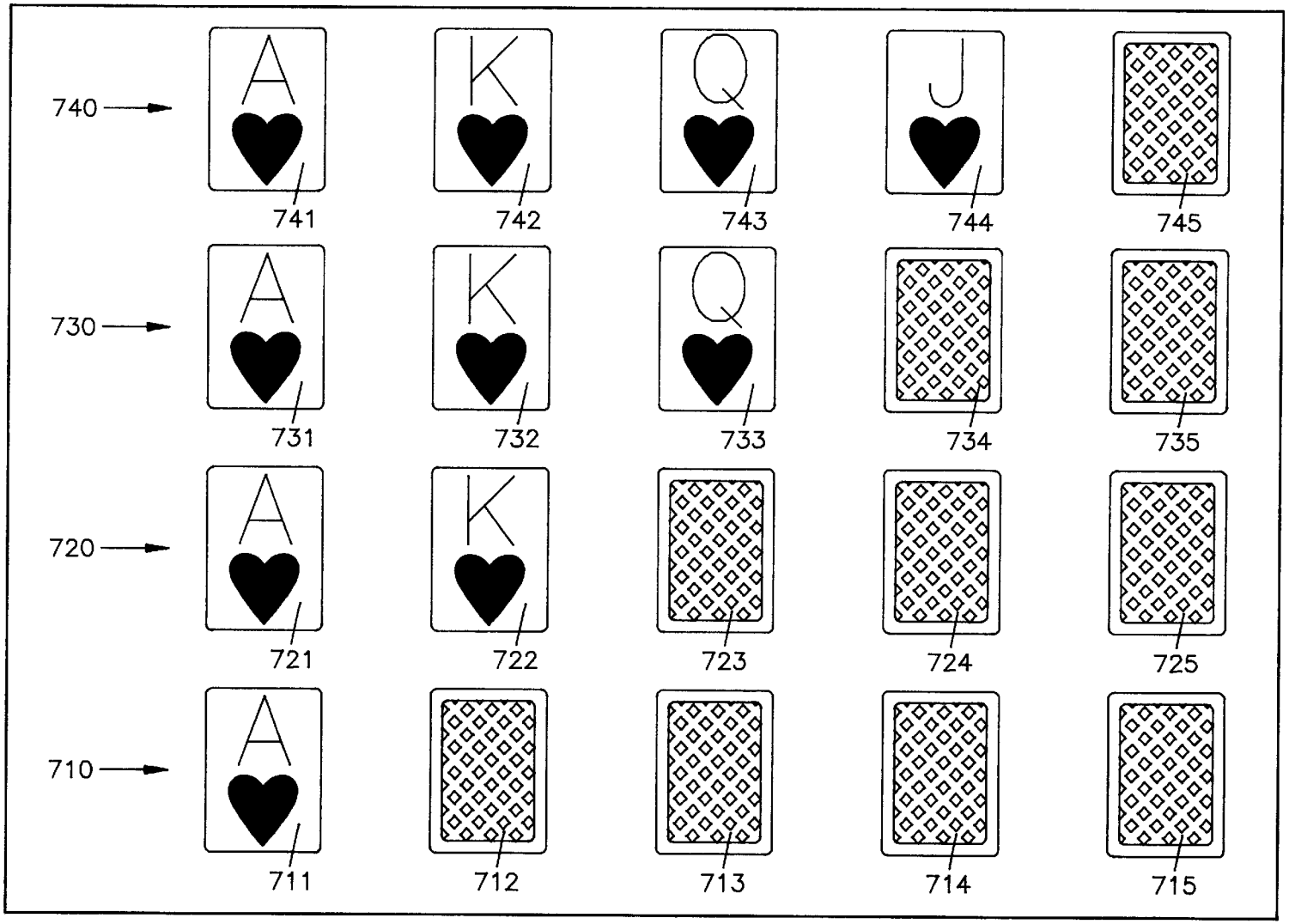
FIG. 23 shows the screen display for version #3A of the present invention after the initial deal of the cards.

An example of a deal of version #3A is shown in FIG. 23. Bottommost row 710 has the Ace of Hearts 711 and four face down cards 712, 713, 714 and 715. The next row 720 has the Ace of Hearts 721, the King of Hearts 722 and three face down cards 723, 724 and 725. The next row 730 has the Ace of Hearts 731, the King of Hearts 732, the Queen of Hearts 733 and two face down cards 734 and 735. The top row 740 has the Ace of Hearts 741, the King of Hearts 742, the Queen of Hearts 743, the Jack of Hearts 744 and one face down card 745.

The player is now given the option of wagering on other rows besides row 710. If the player wishes to wager on other rows, he must bet them in order from bottom to top; e.g. if the player wishes to wager on row 740 he must also wager on rows 720 and 730, besides the initial wager that he made on row 710. After the player has decided how many rows he wishes to wager on, the remaining face down card in each row is revealed and a complete five card stud poker hand is displayed.

The poker hand ranking of each row is determined and, if the player has achieved a winning hand combination, the player is paid based on the amount of his wager on that row and the poker hand ranking achieved as shown in a pay table displayed on the gaming machine.

Version #3B

Version #3B is similar to version #3A except that there are five rows of cards to be dealt to the player and the first row has all five cards face down. Prior to the deal, the player makes a wager on the bottommost row and then all five rows are dealt. The bottommost row has all five cards face down. The next row has one card face up and four cards face down. The next row has two cards face up (with the face up card from the previous row duplicated into this row) and three cards face down. The next row has three cards face up (with the two face up cards from the previous row duplicated into this row) and two cards face down. The top row has four cards face up (with the three face up cards from the previous row duplicated into this row) and one card face down.

If the face down cards are dealt from the same deck, each face down card is different. If the face down cards for each row are dealt each from its own deck (after the face up cards have been removed), then the face down cards in each row could or could not repeat.

Figure 24:
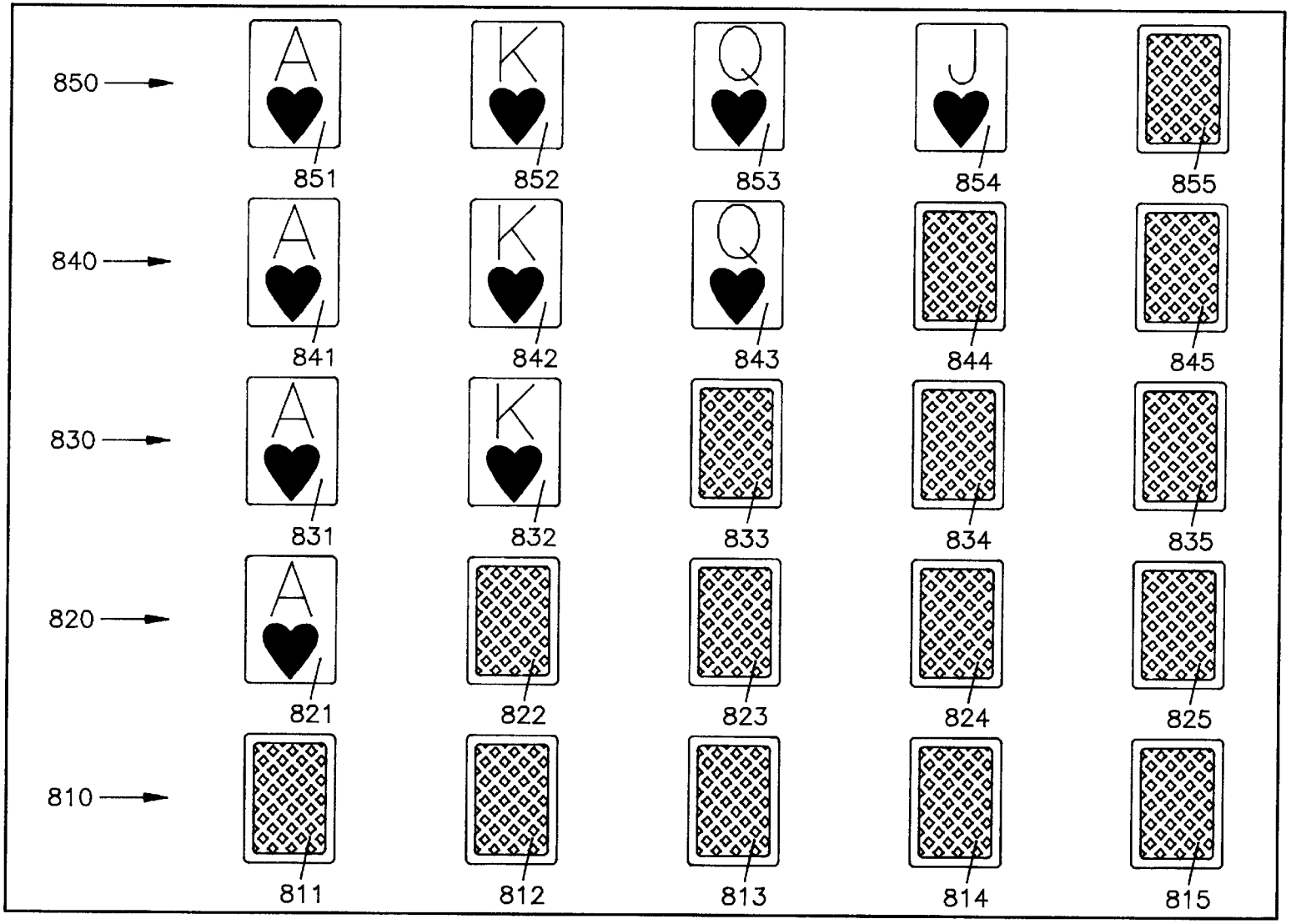
FIG. 24 shows the screen display for version #3B of the present invention after the initial deal of the cards.

An example of a deal of version #3B is shown in FIG. 24. The bottommost row 810 has five face down cards 811, 812, 813, 814 and 815. The next row 820 has the Ace of Hearts 821 and four face down cards 822, 823, 824 and 825. The next row 830 has the Ace of Hearts 831, the King of Hearts 832 and three face down cards 833, 834 and 835. The next row 840 has the Ace of Hearts 841, the King of Hearts 842, the Queen of Hearts 843 and two face down cards 844 and 845. The top row 850 has the Ace of Hearts 851, the King of Hearts 852, the Queen of Hearts 853, the Jack of Hearts 854 and one face down card 855.

The player is now given the option of wagering on other rows besides row 810. If the player wishes to wager on other rows, he must bet them in order from bottom to top; e.g. if the player wishes to wager on row 850 he must also wager on rows 820, 830 and 840, besides the initial wager that he made on row 810. After the player has decided how many rows he wishes to wager on, the remaining face down card in each row is revealed and a complete five card stud poker hand is displayed.

The poker hand ranking of each row is determined and, if the player has achieved a winning hand combination, the player is paid based on the amount of his wager on that row and the poker hand ranking achieved as shown in a pay table displayed on the gaming machine.

Version #3C

This version #3C is similar to the first two versions except that each row has the same number of face up cards of the same rank and suit and can be played with as little as two rows of cards. The player makes a wager on at least the first row of cards. At least two rows of cards are dealt with three cards face up and two cards face down.

If the face down cards are dealt from the same deck, each face down card is different. If the face down cards for each row are dealt each from its own deck (after the face up cards have been removed), then the face down cards in each row could or could not repeat.

Figure 25:
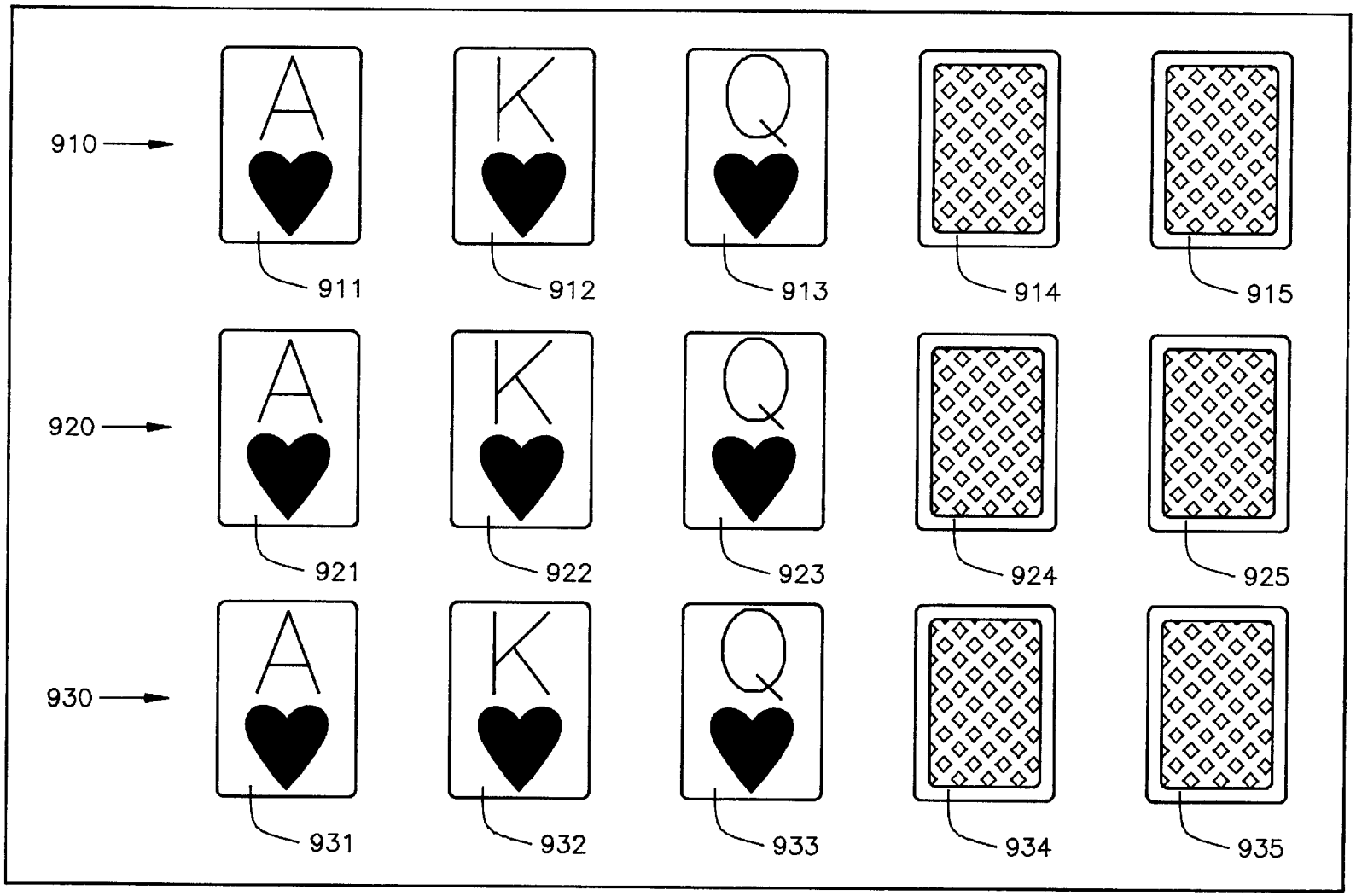
FIG. 25 shows the screen display for version #3C of the present invention after the initial deal of the cards.

An example of a deal of version #3C is shown in FIG. 25 in which three rows are used which is the preferred embodiment. The top row 910 has the Ace of Hearts 911, the King of Hearts 912 and the Queen of Hearts 913 and two face down cards 914 and 915. The middle row 920 has the Ace of Hearts 921, the King of Hearts 922 and the Queen of Hearts 923 and two face down cards 924 and 925. The bottom row 930 has the Ace of Hearts 931, the King of Hearts 932 and the Queen of Hearts 933 and two face down cards 934 and 935.

The player is now given the option of wagering on other rows besides row 910. If the player wishes to wager on other rows, he must bet them in order from top to bottom using the same amount of wager that he made on the top row; e.g. if the player wishes to wager on row 930 he must also wager on row 920, besides the initial wager that he made on row 910. After the player has decided how many rows he wishes to wager on, the remaining face down cards in each row are revealed and a complete five card stud poker hand is displayed.

The poker hand ranking of each row is determined and, if the player has achieved a winning hand combination, the player is paid based on the amount of his wager on that row and the poker hand ranking achieved as shown in a pay table displayed on the gaming machine.

Version #3D

This version #3D is similar to version #3C except that it uses four face up cards and one face down card. Each row has the same number of face up cards of the same rank and suit and can be played with as little as two rows of cards. The player makes a wager on at least the first row of cards. At least two rows of cards are dealt with four cards face up and one card face down.

If the face down cards are dealt from the same deck, each face down card is different. If the face down cards for each row are dealt each from its own deck (after the face up cards have been removed), then the face down cards in each row could or could not repeat.

Figure 26:
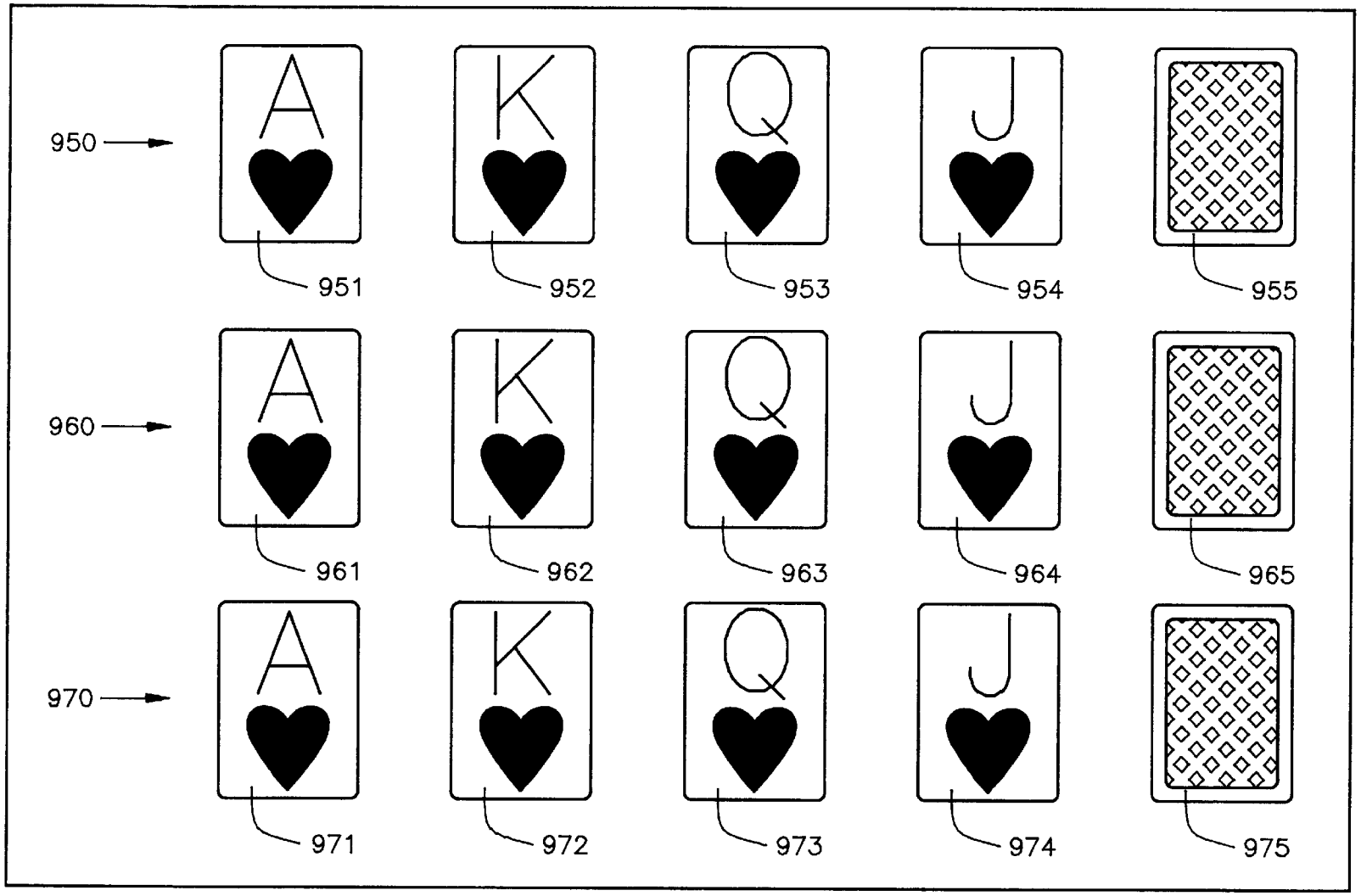
FIG. 26 shows the screen display for version #3D of the present invention after the initial deal of the cards.

An example of a deal of version #3D is shown in FIG. 26 in which three rows are used which is the preferred embodiment. The top row 950 has the Ace of Hearts 951, the King of Hearts 952, the Queen of Hearts 953, the Jack of Hearts 954 and one face down card 955. The middle row 960 has the Ace of Hearts 961, the King of Hearts 962, the Queen of Hearts 963, the Jack of Hearts 964 and one face down card 965. The bottom row 970 has the Ace of Hearts 971, the King of Hearts 972, the Queen of Hearts 973, the Jack of Hearts 974 and one face down card 975.

The player is now given the option of wagering on other rows besides row 950. If the player wishes to wager on other rows, he must bet them in order from top to bottom using the same amount of wager that he made on the top row; e.g. if the player wishes to wager on row 970 he must also wager on row 960, besides the initial wager that he made on row 950. After the player has decided how many rows he wishes to wager on, the remaining face down cards in each row are revealed and a complete five card stud poker hand is displayed.

The poker hand ranking of each row is determined and, if the player has achieved a winning hand combination, the player is paid based on the amount of his wager on that row and the poker hand ranking achieved as shown in a pay table displayed on the gaming machine.

The concepts of the present invention may also be extended to other known casino games such as CARIBBEAN STUD® poker, LET IT RIDE® poker or Texas Hold 'Em poker. The game of CARIBBEAN STUD® poker is described in U.S. Pat. No. 4,836,553, the disclosure of which is incorporated herein by this reference. The game of LET IT RIDE® poker is described in U.S. Pat. No. 5,288,051, the disclosure of which is incorporated herein by this reference. Each of these known casino games could be modified by the addition of another wager which allows the player to bet on the outcome of the dealer's hand.

For example, in CARIBBEAN STUD® poker, a player would be allowed to make an additional wager on the composition of the dealer's five card stud hand. The payouts on this additional wager would be made in accordance with a separate pay table which would allow all players the opportunity to win at the same time for certain high ranking hands achieved by the dealer. In effect this would act as a type of insurance bet for those situations in which the player achieves a high ranking hand but is beaten by the dealer's hand.

In the case of LET IT RIDE®, a bonus hand for the dealer would be created by dealing three extra face down cards on the table layout adjacent to the two common cards used in this game. In addition to making the normal wager on his own hand, the player would also have the option of making a separate wager on the composition of these three extra cards along with the two common cards. This separate wager would pay in accordance with a separate pay table and would allow all players the opportunity to win at the same time. This separate wager could also feature special progressive or non-progressive jackpot awards for a Royal Flush or a sequential Royal Flush achieved by this bonus hand.

As applied to Texas Hold 'Em, the player would make a separate wager on the poker hand value of the five community cards themselves. This could be played either with or without an additional progressive or non-progressive jackpot that would pay for a Royal Flush or a sequential Royal Flush. In those situations where more than one player at the table has made this separate wager and a winning hand occurs, any payouts would be shared by those players making the separate wager in proportion to the amount of their separate wagers.

An example of a pay table that can be used for the separate wagers described in the last three situations would be as follows as shown in Table 1.:

TABLE 1

| | |
|---|---|
| Pair of 6's or Better | 1 to 1 |
| Two Pair | 2 to 1 |
| Three of a Kind | 3 to 1 |
| Straight | 10 to 1 |
| Flush | 20 to 1 |
| Full House | 30 to 1 |

TABLE 1-continued

| | |
|---|---|
| Four of a Kind | 100 to 1 |
| Straight Flush | 800 to 1 |
| Royal Flush | Progressive jackpot |

Other payout tables could be used depending on the winning hand combinations that are designated and the hold percentage desired.

While the invention has been illustrated with respect to several specific embodiments thereof these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game comprising:

a) dealing at least a first row and a second row of at least five cards all face up, each row having the same five cards;

b) selecting none, one or more of the face up cards from either the first row or the second row as cards to be held;

c) the same cards selected to be held from one row being also held in all of the other rows;

d) discarding from each row the cards that were not selected to be held and replacing each of those cards with a face up card;

e) determining the poker hand ranking of the resulting cards of each row.

2. The method of claim 1 including the steps of:

a) a player making a first wager on each row;

b) paying the player a preestablished amount based on the amount of the wager on each row if the resulting cards of each row comprise a predetermined poker hand ranking.

3. A method of playing a card game comprising:

a) dealing a first row, a second row, a third row, a fourth row and a fifth row of at least five cards, with at least the cards in the first row being dealt all face up;

b) selecting none, one or more of the face up cards from the first row as cards to be held;

c) duplicating the cards selected to be held from the first row in all of the other rows;

d) discarding from each row the cards that were not selected to be held and replacing each of those cards with a face up card;

e) determining the poker hand ranking of the resulting cards of each row.

4. The method of claim 3 including the steps of:

a) a player making a first wager on each row;

b) paying the player a preestablished amount based on the amount of the wager on each row if the resulting cards of each row comprise a predetermined poker hand ranking.

5. A method of playing a card game comprising:

a) dealing a first row, a second row, a third row, a fourth row, a fifth row, a sixth row, a seventh row, an eighth row, a ninth row and a tenth row of at least five cards, with at least the cards in the first row being dealt all face up;

b) selecting none, one or more of the face up cards from the first row as cards to be held;

c) duplicating the cards selected to be held from the first row in all of the other rows;

d) discarding from each row the cards that were not selected to be held and replacing each of those cards with a face up card;

e) determining the poker hand ranking of the resulting cards of each row.

6. The method of claim 5 including the steps of:

a) a player making a first wager on each row;

b) paying the player a preestablished amount based on the amount of the wager on each row if the resulting cards of each row comprise a predetermined poker hand ranking.

7. A method of playing a card game comprising:

a) dealing a first row, a second row, a third row, a fourth row, a fifth row, a sixth row, a seventh row, an eighth row, a ninth row and a tenth row of at least five cards, with each row having the same cards and the cards in each row being dealt all face up;

b) selecting none, one or more of the face up cards from the first row as cards to be held;

c) the same cards selected to be held from the first row being also held in all of the other rows;

d) discarding from each row the cards that were not selected to be held and replacing each of those cards with a face up card;

e) determining the poker hand ranking of the resulting cards of each row.

8. The method of claim 7 including the steps of:

a) a player making a first wager on each row;

b) paying the player a preestablished amount based on the amount of the wager on each row if the resulting cards of each row comprise a predetermined poker hand ranking.

9. A method of playing a card game comprising:

a) dealing from a single deck of cards at least a first row and a second row of at least five cards all face up, each row having different cards and each card in the first row being vertically aligned in a column with adjacent cards in the other rows;

b) selecting none, one or more of the face up cards as cards to be held with only one card in each vertical column being eligible for selection as a held card;

c) each card selected to be held from one row being also held in all of the other rows;

d) discarding from each row the cards that were not selected to be held and replacing each of those cards with a face up card;

e) determining the poker hand ranking of the resulting cards of each row.

10. The method of claim 9 including the steps of:

a) a player making a first wager on each row;

b) paying the player a preestablished amount based on the amount of the wager on each row if the resulting cards of each row comprise a predetermined poker hand ranking.

11. A method of playing a card game comprising:

a) dealing from a single deck of cards at least a first row and a second row of at least five cards all face up, each row having different cards;

b) selecting one of the rows of cards as the row to be held;

c) each card from the row selected to be held being duplicated into all of the other rows;

d) selecting none, one or more of the face up cards from any one of the rows as cards to be held;

e) the cards selected to be held in the one row being also held in the other rows;

f) discarding from each row the cards that were not selected to be held and replacing each of those cards with a face up card;

g) determining the poker hand ranking of the resulting cards of each row.

12. The method of claim 11 including the steps of:

a) a player making a first wager on each row;

b) paying the player a preestablished amount based on the amount of the wager on each row if the resulting cards of each row comprise a predetermined poker hand ranking.

13. A method of playing a card game comprising:

a) a player making a first wager on at least a first row and a second row of cards that the player wishes to play;

b) dealing at least the first row and the second row, each row having at least five cards with four cards face up and one card face down, each row having the same four face up cards;

c) offering the player the opportunity to double his wager on any or all of the rows;

d) turning face up the fifth card in each row;

e) determining the poker hand ranking of the resulting cards of each row; and f) paying the player a preestablished amount based on the amount of the wager on each row if the resulting cards of each row comprise a predetermined poker hand ranking.

14. A method of playing a card game comprising:

a) a player making a first wager on a first row;

b) dealing at least four rows of cards, each row having at least five cards; each card in the first row vertically aligned in a column with adjacent cards in the other rows; the first row having one card face up and four cards face down; the second row having two cards face up and three cards face down with one of the face up cards being the same card as the face up card in the first row; the third row having three cards face up and two cards face down with two of the face up cards being the same cards as the face up cards in the second row; the fourth row having four cards face up and one card face down with three of the face up cards being the same cards as the face up cards in the third row;

c) offering the player the opportunity to wager on one or more of the rows other than the first row;

d) turning face up all of the face down cards in each row;

e) determining the poker hand ranking of the resulting cards of each row; and f) paying the player a preestablished amount based on the amount of the wager on each row if the resulting cards of each row comprise a predetermined poker hand ranking.

15. A method of playing a card game comprising:

a) a player making a first wager on a first row;

b) dealing at least five rows of cards, each row having at least five cards; each card in the first row vertically aligned in a column with adjacent cards in the other rows; the first row having five cards face down; the second row having one card face up and four cards face down; the third row having two cards face up and three cards face down with one of the face up cards being the same card as the face up card in the second row,;the fourth row having three cards face up and two cards face down with two of the face up cards being the same cards as the face up cards in the third row; the fifth row having four cards face up and one card face down with three of the face up cards being the same cards as the face up cards in the fourth row;

c) offering the player the opportunity to wager on one or more of the rows other than the first row;

d) turning face up all of the face down cards in each row;

e) determining the poker hand ranking of the resulting cards of each row; and f) paying the player a preestablished amount based on the amount of the wager on each row if the resulting cards of each row comprise a predetermined poker hand ranking.

16. A method of playing a card game comprising:

a) a player making a first wager on a first row;

a) dealing at least two rows of cards, each row having at least five cards; each row having three cards face up and two cards face down with the face up cards in each row being the same cards;

c) offering the player the opportunity to wager on one or more of the rows other than the first row;

d) turning face up all of the face down cards in each row;

e) determining the poker hand ranking of the resulting cards of each row; and f) paying the player a preestablished amount based on the amount of the wager on each row if the resulting cards of each row comprise a predetermined poker hand ranking.

17. A method of playing a card game comprising:

a) player making a first wager on a first row;

a) dealing at least two rows of cards, each row having at least five cards; each row having four cards face up and one card face down with the face up cards in each row being the same cards;

c) offering the player the opportunity to wager on one or more of the rows other than the first row;

d) turning face up all of the face down cards in each row;

e) determining the poker hand ranking of the resulting cards of each row; and f) paying the player a preestablished amount based on the amount of the wager on each row if the resulting cards of each row comprise a predetermined poker hand ranking.

* * * * *